US007455365B2

(12) United States Patent
Caruso et al.

(10) Patent No.: US 7,455,365 B2
(45) Date of Patent: Nov. 25, 2008

(54) SEATING STRUCTURE HAVING FLEXIBLE SUPPORT SURFACE

(75) Inventors: Jerome Carmel Caruso, Lake Forest, IL (US); Steven Jerome Caruso, Antioch, IL (US); John Fredric Aldrich, Grandville, MI (US); Andrew Keith Hector, Grandville, MI (US); Thomas William Granzow, Planwell, MI (US); Dean Thomas Miller, Wyoming, MI (US); Richard Thomas Peek, Caledonia, MI (US)

(73) Assignee: Herman Miller, Inc., Zeeland, MI (US)

( * ) Notice: Subject to any disclaimer, the term of this patent is extended or adjusted under 35 U.S.C. 154(b) by 941 days.

(21) Appl. No.: 10/809,279

(22) Filed: Mar. 25, 2004

(65) Prior Publication Data

US 2005/0001461 A1 Jan. 6, 2005

Related U.S. Application Data

(63) Continuation-in-part of application No. 09/897,153, filed on Jun. 29, 2001, now Pat. No. 6,726,285, application No. 10/809,279, filed on Mar. 25, 2004, which is a continuation-in-part of application No. PCT/US02/00024, filed on Jan. 3, 2002.

(60) Provisional application No. 60/215,257, filed on Jul. 3, 2000.

(51) Int. Cl.
*A47C 7/02* (2006.01)

(52) U.S. Cl. ..... 297/452.46; 297/452.21; 297/452.15

(58) Field of Classification Search ..... 297/452.21, 297/452.23, 452.24, 452.32, 452.37, 452.42, 297/452.43, 452.46, 452.52; 428/98, 131, 428/174, 172; 5/653, 652.1
See application file for complete search history.

(56) References Cited

U.S. PATENT DOCUMENTS

| | | | |
|---|---|---|---|
| 54,314 | A | 5/1866 | Farmer |
| 567,639 | A | 9/1896 | Crouch |
| 662,647 | A | 11/1900 | Howe |
| 1,005,330 | A | 10/1911 | Schmits et al. |
| 1,769,294 | A | 7/1930 | Johnson et al. |

(Continued)

FOREIGN PATENT DOCUMENTS

| | | | |
|---|---|---|---|
| EP | 0 021 191 | A2 | 6/1980 |
| EP | 0 021 191 | B1 | 6/1980 |
| GB | 2088206 | | 6/1982 |
| GB | 2225229 | A | 5/1990 |
| WO | WO 00/22961 | | 4/2000 |
| WO | WO 115572 | A1 | 3/2001 |

OTHER PUBLICATIONS

Digital images of "Y psilon" Chair, date unknown.

(Continued)

*Primary Examiner*—Sarah B McPartlin
(74) *Attorney, Agent, or Firm*—Brinks Hofer Gilson & Lione

(57) ABSTRACT

A seating structure includes a plurality of boss structures arranged in a pattern and a plurality of web structures joining adjacent boss structures within the pattern. At least some of the web structures are non-planar and at least some adjacent web structures are spaced apart such that they define openings therebetween. In another aspect, the seating structure includes a plurality of boss structures arranged in a pattern and defining a support surface and a plurality of web structures joining adjacent boss structures within the pattern. At least some adjacent web structures are spaced apart and shaped such that they define substantially non-circular openings therebetween when viewed in a direction substantially perpendicular to the support surface. A reinforced frame is also provided.

20 Claims, 18 Drawing Sheets

U.S. PATENT DOCUMENTS 2,126,439 A 8/1938 Zerbee
2,260,352 A 10/1941 Trapani
2,667,654 A * 2/1954 Goessele et al. ..... 15/215
2,878,860 A 3/1959 Brattrud
3,041,109 A 6/1962 Eames et al.
3,059,919 A 10/1962 Marchino
3,080,579 A 3/1963 Gordon
3,107,944 A 10/1963 Baermann
3,117,819 A 1/1964 Kudriavetz, Jr.
3,120,407 A 2/1964 Propst
3,140,086 A 7/1964 Lawson
3,162,487 A * 12/1964 Trotman ..... 297/452.45
3,198,578 A 8/1965 Geoffrey et al.
3,217,786 A 11/1965 Earl
RE25,943 E 12/1965 Lawson
3,226,285 A 12/1965 Iovenko
3,233,885 A 2/1966 Propst
3,514,156 A * 5/1970 Fields ..... 297/452.45
3,565,482 A 2/1971 Blodee
3,681,797 A 8/1972 Messner
3,720,568 A 3/1973 Rowland
3,722,955 A 3/1973 Trotman
3,767,261 A 10/1973 Rowland
3,840,269 A 10/1974 Ambrose
3,877,750 A 4/1975 Scholpp
4,143,916 A * 3/1979 Trotman et al. ..... 297/452.45
4,318,556 A 3/1982 Rowland
4,367,897 A 1/1983 Cousins
4,368,917 A 1/1983 Urai
4,377,016 A * 3/1983 Niermeijer ..... 15/215
4,390,210 A 6/1983 Wisniewski et al.
4,399,574 A 8/1983 Shuman
4,435,015 A 3/1984 Trotman et al.
4,533,174 A 8/1985 Fleishman
4,582,361 A 4/1986 Kennel
4,585,272 A 4/1986 Ballarini
4,660,887 A 4/1987 Fleming et al.
4,713,854 A 12/1987 Graebe
4,761,035 A 8/1988 Urai
4,789,201 A 12/1988 Selbert
D301,088 S 5/1989 Kawaguchi
4,826,249 A 5/1989 Bradbury
4,828,320 A 5/1989 Saiger
4,834,458 A 5/1989 Izumida et al.
4,856,846 A 8/1989 Lohmeyer
4,889,387 A 12/1989 Gregory
4,913,493 A 4/1990 Heidmann
4,980,936 A 1/1991 Frickland
4,993,164 A 2/1991 Jacobsen
5,013,089 A 5/1991 Abu-Isa et al.
5,025,519 A 6/1991 Spann
5,067,196 A * 11/1991 Chen ..... 15/238
5,067,772 A * 11/1991 Koa ..... 297/452.55
5,094,580 A 3/1992 Abe
5,154,485 A 10/1992 Fleishman
5,249,839 A 10/1993 Falks et al.
D346,279 S 4/1994 Stumpf et al.
5,318,348 A 6/1994 Hess
5,320,410 A 6/1994 Faiks et al.
5,399,406 A * 3/1995 Matsuo et al. ..... 428/57
5,439,271 A 8/1995 Ryan
5,441,331 A 8/1995 Vento
5,445,436 A 8/1995 Kemnitz
5,459,896 A 10/1995 Raburn et al.
D368,399 S 4/1996 Buffon
5,529,373 A 6/1996 Olson et al.
5,551,673 A 9/1996 Furusawa et al.
D377,431 S 1/1997 Stumpf et al.
5,662,383 A 9/1997 Hand
5,679,439 A * 10/1997 Schmidt et al. ..... 428/178
5,747,140 A 5/1998 Heerklotz
5,762,403 A 6/1998 Robinson
5,833,321 A 11/1998 Kim et al.
5,934,758 A * 8/1999 Ritch et al. ..... 297/452.54
6,029,962 A 2/2000 Shorten et al.
6,035,901 A 3/2000 Stumpf et al.
6,059,368 A 5/2000 Stumpf et al.
6,106,063 A 8/2000 Dauphin
6,170,808 B1 1/2001 Kutschi
6,193,318 B1 2/2001 Becker et al.
6,254,190 B1 7/2001 Gregory
6,420,015 B1 * 7/2002 Nord et al. ..... 428/172
6,439,665 B1 8/2002 Cvek
6,451,400 B1 * 9/2002 Brock et al. ..... 428/44
6,523,898 B1 2/2003 Ball et al.
D471,024 S 3/2003 Chadwick et al.
D471,042 S 3/2003 Schmitz et al.
D471,370 S 3/2003 Schmitz et al.
6,546,578 B1 4/2003 Steinmeier
6,550,866 B1 4/2003 Su
D474,346 S 5/2003 Saylor et al.
D475,859 S 6/2003 Kryger
6,588,842 B2 7/2003 Stumpf et al.
6,623,079 B2 9/2003 Gregory
D485,097 S 1/2004 Raftery
D486,027 S 2/2004 Baxter et al.
D487,359 S 3/2004 Giugiaro
6,726,285 B2 4/2004 Caruso et al.
6,726,286 B2 4/2004 Stumpf et al.
D489,191 S 5/2004 Ma
D489,541 S 5/2004 Su
D489,542 S 5/2004 Giugiaro
6,729,691 B2 5/2004 Koepke et al.
D490,994 S 6/2004 Schmitz et al.
6,869,140 B2 3/2005 White et al.
6,901,617 B2 6/2005 Sprouse et al.
6,954,315 B2 * 10/2005 Tracy ..... 359/707
2002/0096931 A1 7/2002 White et al.
2005/0001464 A1 1/2005 Caruso et al.
2005/0116526 A1 6/2005 Vanderiet et al.
2006/0103222 A1 5/2006 Caruso et al.

OTHER PUBLICATIONS

Vitra "Y psilon" brochure, date unknown.
International Search Report, International Application PCT/US02/00024, May 29, 2002.
"Aeron Chair", *Herman Miller*, 1995 (4 pages).
"IDEA" advertisement, *Intes ISA*, High Point NC, date unknown (1 page).
International Preliminary Examination Report from PCT/US2002/00024, Apr. 12, 2005 (4 pages).
"New! Bungie High Back Chair" advertisement, (source and date unknown).
Pearlman, C., "Made to Measure" *I.D.*, Sep.-Oct. 1994 (8 pages).
Zurowski, T., "Designers Rate . . . Herman Miller's Aeron Chair", *Interiors*, Jul. 1995 (1 page).

* cited by examiner

FIG. 7
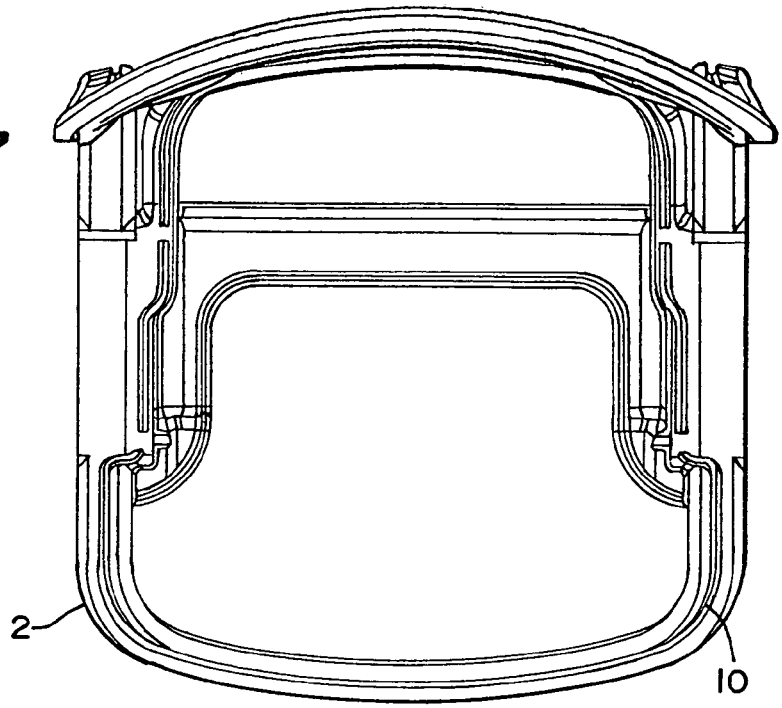
FIG. 8
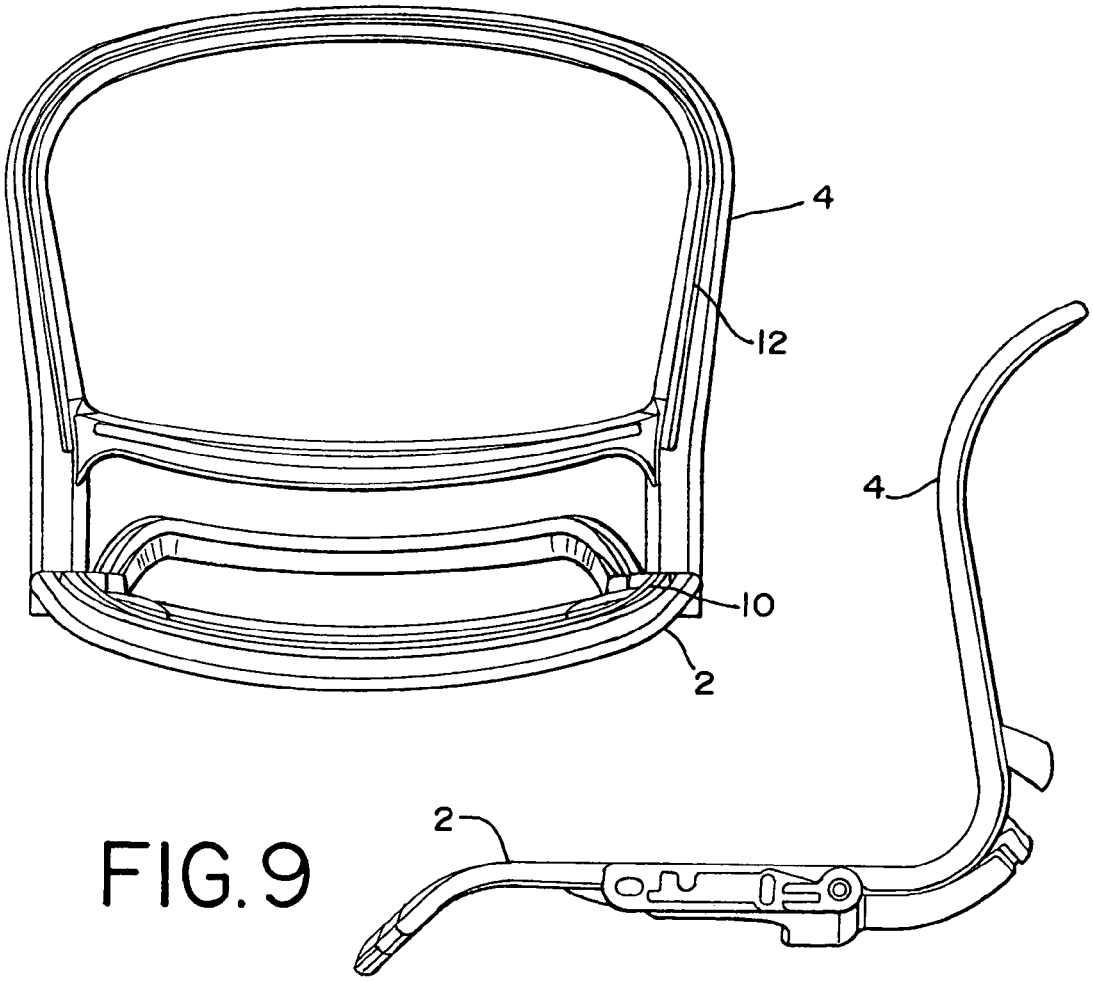
FIG. 9

SEATING STRUCTURE HAVING FLEXIBLE SUPPORT SURFACE

This application is a continuation-in-part of U.S. patent application Ser. No. 09/897,153, filed Jun. 29, 2001, now U.S. Pat. No. 6,726,285 which claims the benefit of U.S. Provisional Application No. 60/215,257, filed Jul. 3, 2000, the entire disclosures of which are hereby incorporated herein by reference. This application also is a continuation-in-part of PCT Application PCT/US02/00024, filed Jan. 3, 2002, the entire disclosure of which is hereby incorporated herein by reference.

FIELD OF INVENTION

The present invention relates to chairs and seating normally associated with but not limited to residential or commercial office work. These chairs employ a number of structures and methods that enhance the user's comfort and promote ergonomically healthy sitting. These methods include various forms of padding and/or flexing of the seat and back as well as separate mechanical controls that control the overall movement of the seat and back.

BACKGROUND

Various approaches to making a chair seat and/or back form fitting for various users are known in the industries of seating manufacture. These approaches range from the rather traditional use of contouring synthetic foam, to seat/back shells that have a degree of flex. There have also been approaches that use a frame that has a membrane or sling stretched or supported across or within a frame. Problems can arise from each of these approaches.

For example, under normal manufacturing conditions, it can be difficult to vary the amount of firmness and corresponding support in different areas of a foam padded cushion. Additionally, foam can lead to excessive heat-build-up between the seating surface and the occupant. One of the problems with foam is the forming and molding process. Current manufacturing technology makes it a relatively inefficient process compared with the manufacture of the other components that make up a chair or seating surface. Often, the forming/molding of a contoured seating surface can be slow, thereby requiring the manufacturer to make several molds (typically hand filled) in order to maintain an efficient level of production.

Another problem inherent to the use of foam is that in order to achieve a finished look, the cushions typically must be covered, e.g. upholstered. When a manufacturer upholsters a cushion, a number of issues may arise. For example, the formed or molded foam may have curves, many of which can be compound-curves, which leads a manufacturer to use glue or other adhesives to make the fabric conform to the contours. This laminating technique often makes the foams surface firmer than it was when it was originally molded/formed because the glue/adhesive and the fabric are now part of the foam structure. Additionally, the amount of change in firmness can vary from fabric to fabric which results in an unpredictability of the firmness of a cushion from one manufactured unit to the next.

Alternatively, if a slipcover is used, it must be sized properly. Such sizing can be difficult as a result of the differing mechanical properties found from one fabric to another. The most important properties of a fabric when upholstering a contoured surface are its thickness and its rate of stretch. Thickness variations can make one fabric upholster smooth around radii or contours, while a thicker one will wrinkle in the same area. Variations in the amount of stretch can lead to other problems. Therefore, a proper size slipcover in one type of fabric, with its stretch characteristics, may be the wrong size in another type or style of fabric. Often a manufacturer will "wrap" a piece of fabric around a cushion and then staple the fabric to the underside/backside of the cushion. This approach also suffers from the aforementioned problems associated with using variable fabrics. Additionally, the manufacturer must now cover the staples and the area of the cushion not covered by fabric in order to achieve a finished look. This leads to an additional manufacturing step or molding etc. that often also has to be upholstered.

The other reality of cushion upholstery, regardless of the techniques used, is that whether it is done in a small shop or in a production situation, it can be the most labor-intensive aspect of chair/seating construction.

In the case of incorporating flex into the shells of a chair, it can be difficult to achieve the proper amount of flex in the right areas to give correct ergonomic comfort for a wide range of individuals. In the case of a membrane approach, the curves imparted on the membrane by the frame are often simple in nature (non-compound) and thus cannot provide the proper contouring necessary for ergonomic comfort. Also, this approach can lead to "hammocking," where the areas adjacent a pressed area have the tendency of folding inward, squeezing the occupant, and not yielding the proper ergonomic curvatures. An additional problem with membrane chairs is that the tension of the membrane may not be appropriate for all ranges of users.

To solve some of these problems, manufacturers have produced "sized" (i.e. small, medium and large) chairs that effectively narrow the amount of contouring-compromise that the designer must normally exercise. This approach, however, may require the manufacturer to tool three independent products instead of one, and the manufacturers, wholesalers, and retailers having to stock (in this example) three times the quantity of product. Additionally, the purchaser ends up with a chair that at some point in the future may be the wrong size for a different user.

In some seating structures, the frame members, such as a backrest support, may be made from metal to accommodate the large loads applied thereto by the user. Metal, however, can be expensive to purchase as a raw material, as well as to form into a final product. Moreover, the resultant chair is relatively heavy, leading to increased shipping costs and decreased portability. In some cases, various components have been made of plastic or composite materials, e.g., fiberglass. These components, however, can be susceptible to wear and often cannot carry the necessary loads, for example in bearing.

BRIEF SUMMARY

In one aspect, the present invention relates to an improved method of constructing seating structures and surfaces, which provides greater comfort through superior surface adjustment for a variety of users. In one embodiment, the seating surface construction is comprised of a plurality of support sections (bosses/platforms) and of a plurality of web connectors interconnecting the support sections. In one embodiment, the support sections, or bosses/platforms, are more rigid than their corresponding web connectors. A variety of methods are disclosed for making the bosses/platforms with a greater degree of rigidity than the web connectors.

One exemplary method disclosed herein includes making the thickness of the bosses/platforms different than the thickness of the web connectors. Another exemplary method includes providing the bosses/platforms with stiffening geometry that provides a greater degree of rigidity than the web connectors. Such stiffening means can include in one embodiment the addition of one or more returns or ribs. Another exemplary solution is to make the bosses/platforms out of a different material than the web connectors. Yet another solution includes constructing the webs with a geometry that acts as a hinge. Yet another embodiment includes providing a given geometry and material that can exhibit stretch in addition to flexure.

In one embodiment, a seating structure includes a plurality of boss structures arranged in a pattern and a plurality of web structures joining adjacent boss structures within the pattern. At least some of the web structures are non-planar. At least some adjacent web structures are spaced apart such that they define openings therebetween. In various embodiments, the boss structures can be the same size and/or shape, or different sizes and/or shapes.

In another aspect, a seating structure includes a support structure having a first component made of a first material. The first component has opposite side portions defining a cavity therebetween. A plate-like second component made of a second material is disposed in the cavity and is secured to the first component. The second component defines at least one engagement location. The second material is stronger than the first material. A third component engages the second component at the engagement location.

In yet another aspect, a seating structure includes a plurality of boss structures arranged in a pattern and defining a support surface and a plurality of web structures joining adjacent boss structures within the pattern. At least some adjacent web structures are spaced apart and shaped such that they define substantially non-circular openings therebetween when viewed in a direction substantially perpendicular to the support surface. In various exemplary embodiments, the openings are X-shaped and V-shaped.

In various embodiments, the structure provides increased airflow to contact areas of the occupant's body, relative to foam for example. In addition, the seating surface can be made more efficiently and economically relative to foam and other types of seating surfaces. Moreover, the structure can be formed to provide different flexure characteristics in different areas of the seating structure.

The support member with its different materials also provides advantages. In particular, the plate-like structure can be provided in areas requiring high strength, with the remainder of the structure being made from a lighter and/or less expensive material.

BRIEF DESCRIPTION OF DRAWINGS

FIG. 7 is a top view of a frame structure configured to support the back support and seat support shown in FIGS. 3-6.

FIG. 8 is a front view of frame structure configured to support the back support and seat support shown in FIGS. 3-6.

FIG. 9 is a side view of frame structure configured to support the back support and seat support shown in FIGS. 3-6.

DETAILED DESCRIPTION OF THE PRESENTLY PREFERRED EMBODIMENTS

Figure 2:
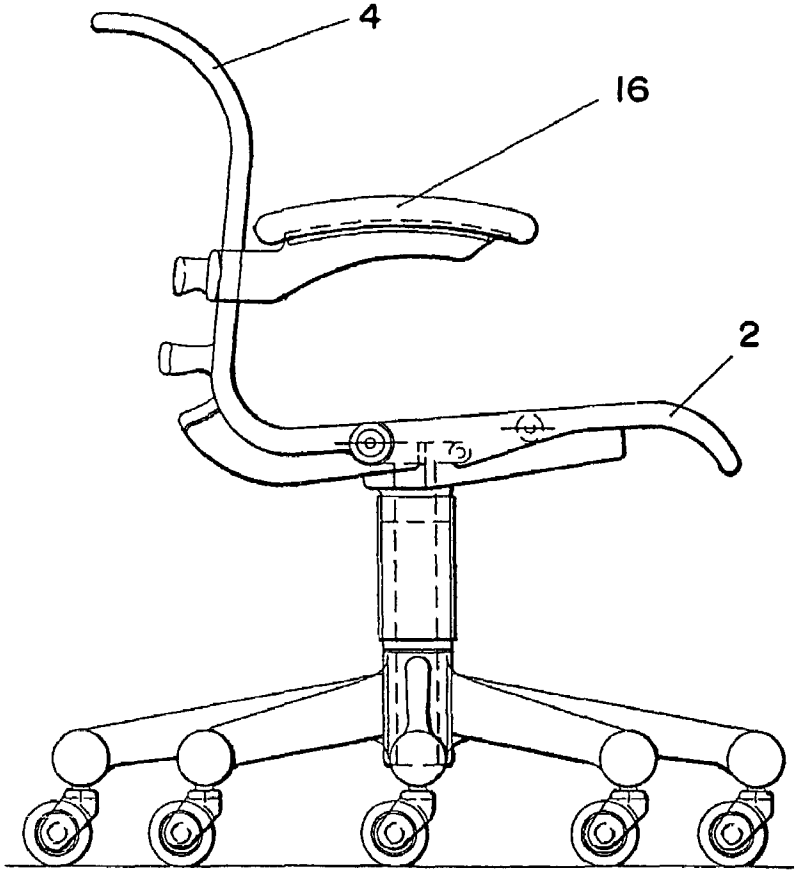
FIG. 2 is a side elevation of the seating structure shown in FIG. 1.
Figure 1:
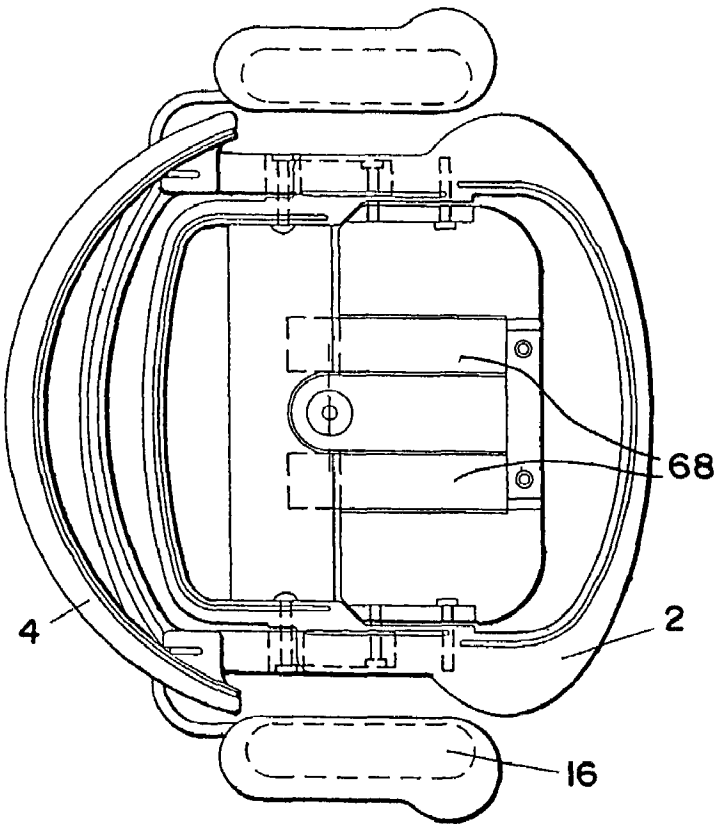
FIG. 1 is top view of a seating structure without a seat support.

While the invention will be described in connection with one or more preferred embodiments, it will be understood that we do not intend to limit the invention to those embodiments.

On the contrary, we intend to cover all alternatives, modifications and equivalents within the spirit and scope of the invention.

Referring to FIGS. 22-29, 38 and 39, various embodiments of a seating structure, configured as a chair, are shown. It should be understood that the term "seating structure" includes any structure intended to support the body of a user, whether standing, sitting or lying, and includes without limitation chairs, sofas, benches, automotive seats, stools, suspended structures, etc.

The chair 26 includes a back 28 having a pair of support arms 30 pivotally connected to a control housing 40 at a first pivot axis 32 and pivotally connected to opposite sides of a seat 44 at a second pivot axis 34. The seat 44 is pivotally connected to a link 42 at a third pivot axis 36 positioned forwardly of said first and second pivot axes 32, 34. The link 42 is pivotally connected to the control housing 40 at a fourth pivot axis 38 positioned below the third pivot axis 36 and forwardly of the first and second pivot axes 32, 34. The link 42 extends laterally across the housing and includes a pair of lower lugs 46 pivotally secured to opposite sides of the control housing 40 and a pair of upper lugs 48 pivotally secured to opposite sides of the seat 44. The link 42 is preferably made of plastic, such as glass-filled (e.g., 33%) polypropylene. The control housing 40, back support arms 30, seat 44 and link 42 form a four-bar linkage that provides for synchronous tilting of the seat and back.

An adjustable support column 50 has an upper end connected to the control housing and a lower end connected to a base 52. The base includes a plurality of support arms terminating in casters 54. The casters can be configured as conventional two-wheel casters 56, or as a one-wheeled caster 54, disclosed for example in U.S. patent application Ser. No. 10/613,526, filed Jul. 3, 2003, the entire disclosure of which is hereby incorporated herein by reference.

Figure 26:
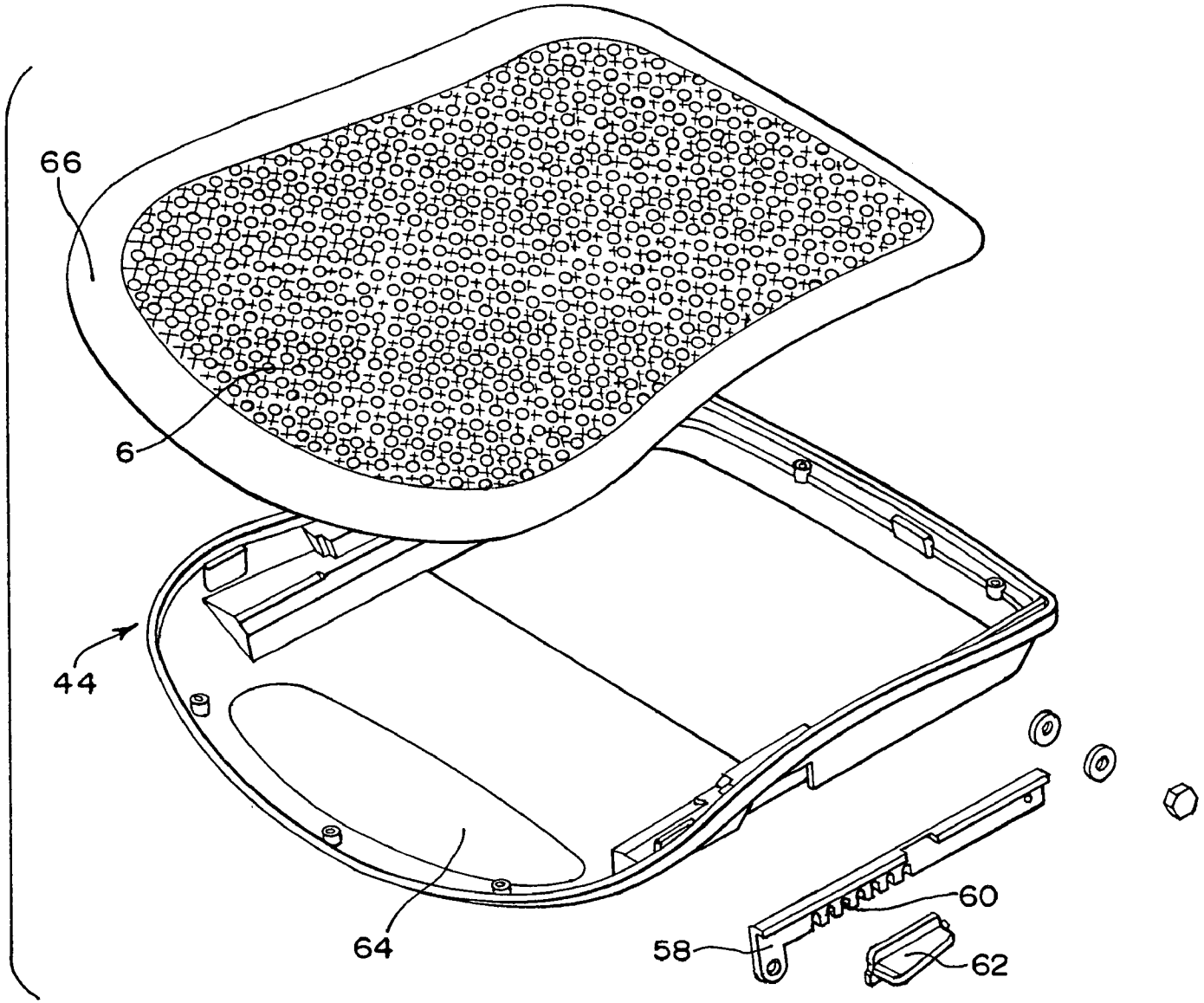
FIG. 26 is an exploded perspective view of a seat support assembly.

Referring to FIG. 26, the seat includes a pair of seat links 58 each having opposite ends pivotally connected respectively to the back support arm 30 and link 42 at the second and third pivot axes 34, 36. The seat link 58 includes a rack 60 formed along a bottom edge thereof. The seat further includes a frame 64 slidably supported on the seat links. For example, the frame can be slidably connected to an upper flange of the seat link, or it can be slidably captured thereon with various fasteners, which can be permanent or removable, for example by a snap-fit or with screws. The frame 64 is preferably made of plastic, such as glass-filled (e.g., 20%) polypropylene. It should be understood that the various glass-filled materials disclosed herein can have various percentages of fill, or can be unfilled. Of course, other plastic materials or metal can also be used. The seat links 58 are preferably made of metal, such as steel. A lever 62 or latch is pivotally secured to the seat frame 64 and is releasable engageable with the rack 60 to secure the seat frame at a desired location relative thereto.

A support member 6, made of various web 18 and boss structures 20, as described below, is secured to the frame 64. In one embodiment, the support member 6 includes a peripheral ring portion 66, or frame, that is secured to the frame 64. In one embodiment, a cushion is disposed on top of the support member and is covered with a fabric. In another embodiment, the support member is directly exposed to the user without any covering disposed thereover. In yet another embodiment, a thin flexible covering, such as a fabric, is disposed over the support member without a cushion. In other embodiments, a membrane can be secured to the frame, as disclosed for example in U.S. patent application Ser. No. 10/738,641, filed Dec. 17, 2003, and U.S. Pat. No. 6,386,634, the entire disclosures of which are hereby incorporated herein by reference.

Figure 24:
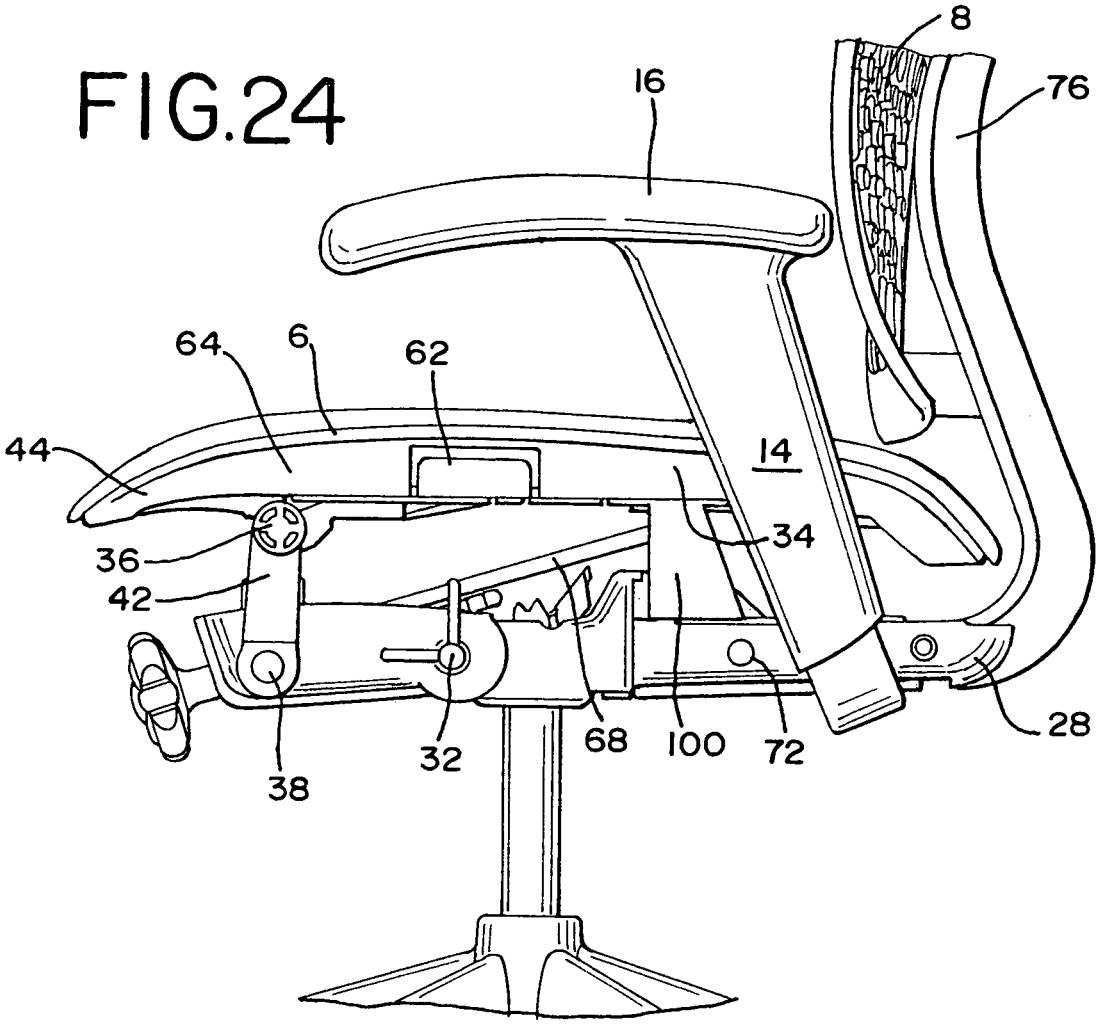
FIG. 24 is a side view of the chair shown in FIG. 22.
Figure 25:
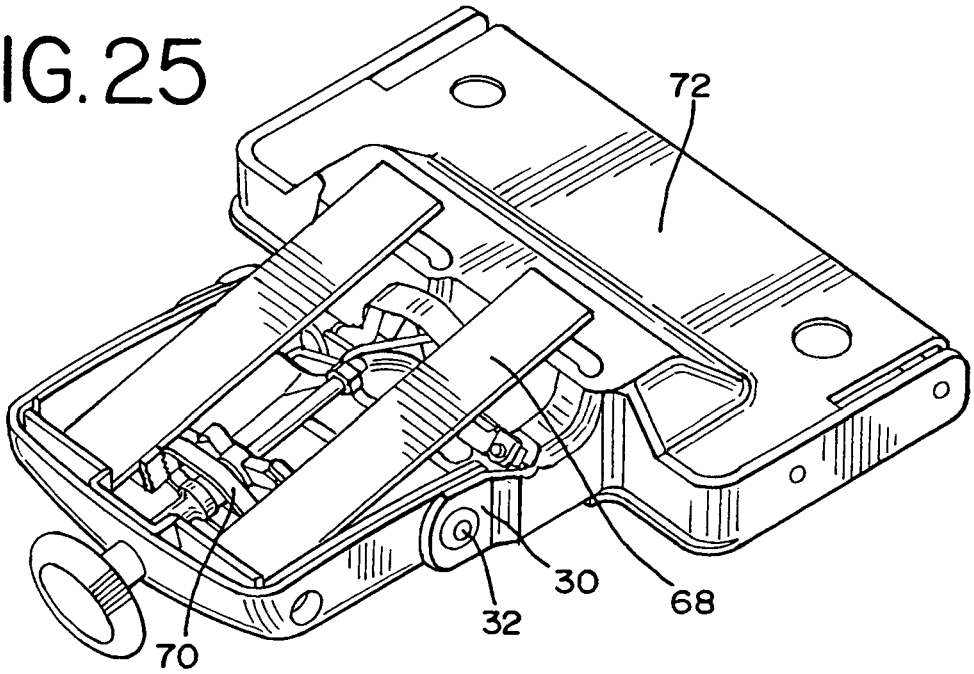
FIG. 25 is a perspective view of a tilt control assembly.

The tilt control assembly, shown in FIGS. 24 and 25, includes a pair of leaf springs 68 (shown in an unloaded position) that bias the seat and back to an upright position. A moveable fulcrum member 70 can be translated to adjust the amount of biasing force exerted by the springs 68.

In one embodiment, shown in FIGS. 22-25, the back 28 includes a support bracket 72 defining the support arms 30. The rear end of the springs 68 engage a bottom surface, which can be downwardly raised, of the support bracket. The rear ends of the spring slidably engage the bottom surface of the support bracket as the support bracket is rotated relative to the housing. A back frame 74 includes a pair of opposite uprights 76 each having a forwardly extending portion 80, secured to one side of the support bracket 72, and an upwardly extending section 80. A cross-member 78 is secured to and extends between the upper ends of the upwardly extending portions. In other embodiments, the cross member is omitted.

Figure 28:
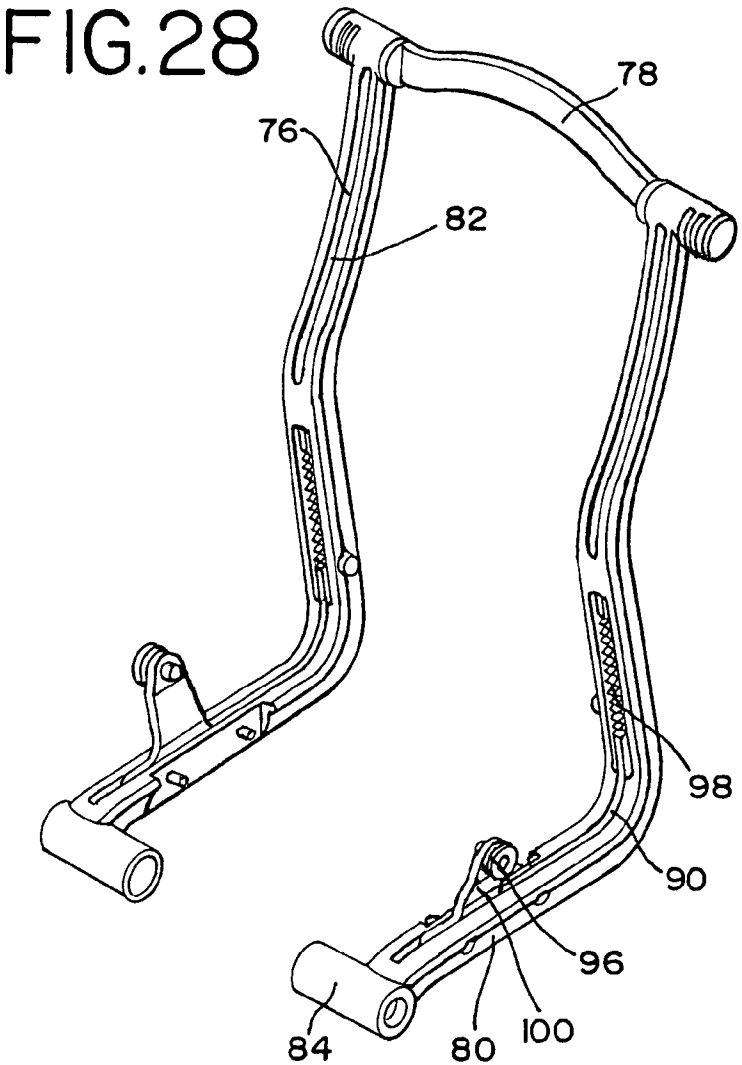
FIG. 28 is a perspective view of the back support frame assembly shown in FIG. 27.
Figure 27:
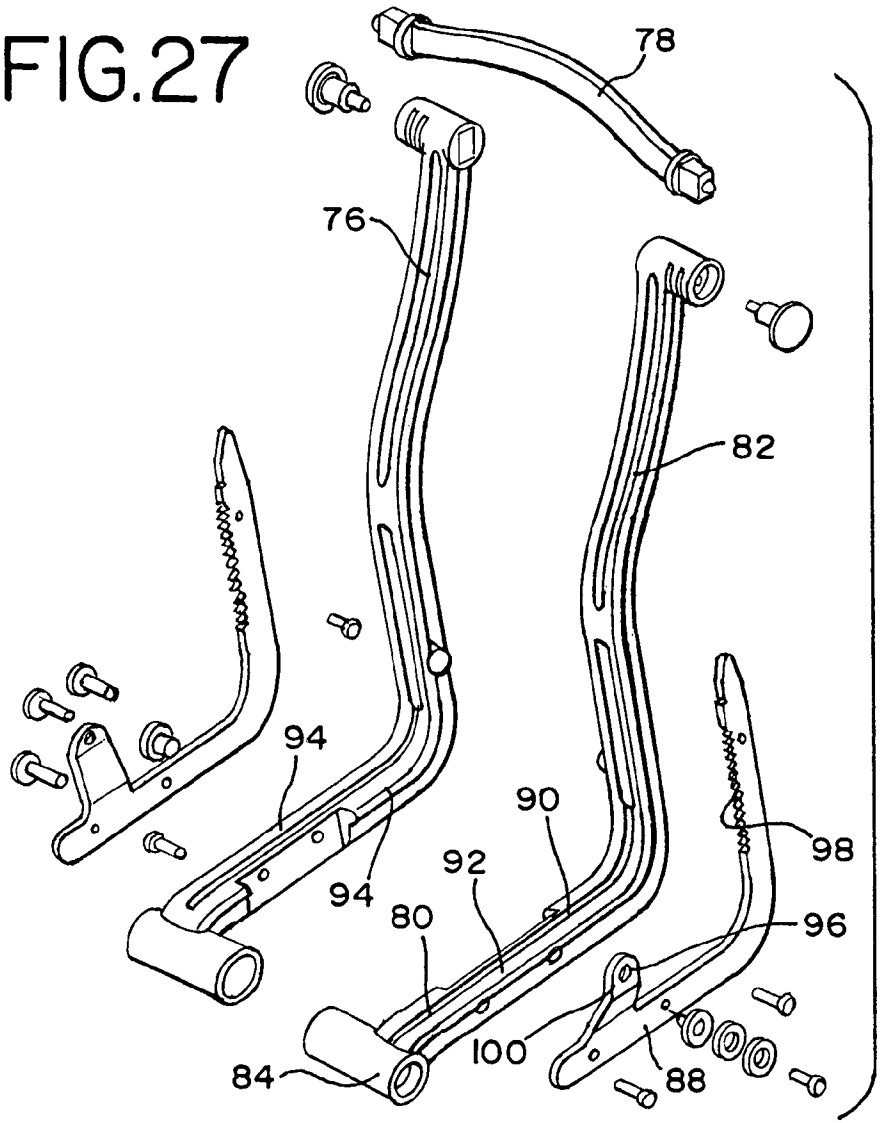
FIG. 27 is an exploded perspective view of a back support frame assembly.
Figure 29:
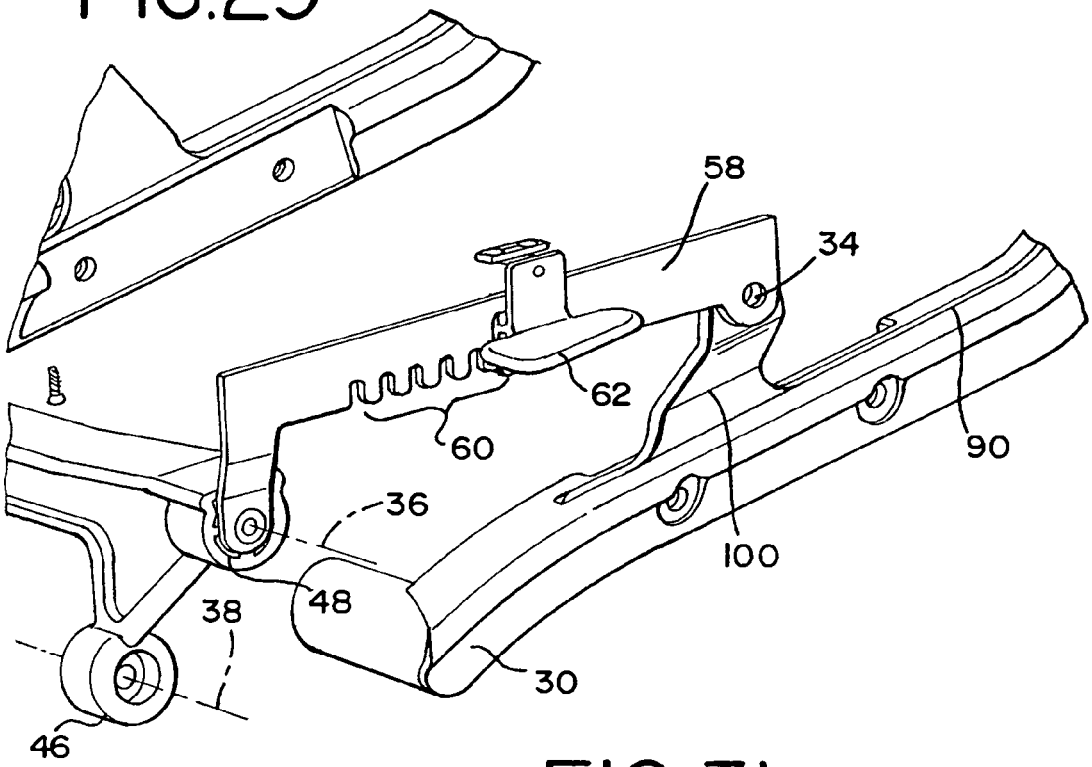
FIG. 29 is an enlarged, partial perspective view of three links of a four-bar linkage assembly.

In an alternative embodiment, shown in FIGS. 27 and 28, the forwardly extending portions 80 of the uprights have end portions 84 that are configured as lugs and are pivotally mounted to the control housing at the first pivot axis 32.

Figure 22:
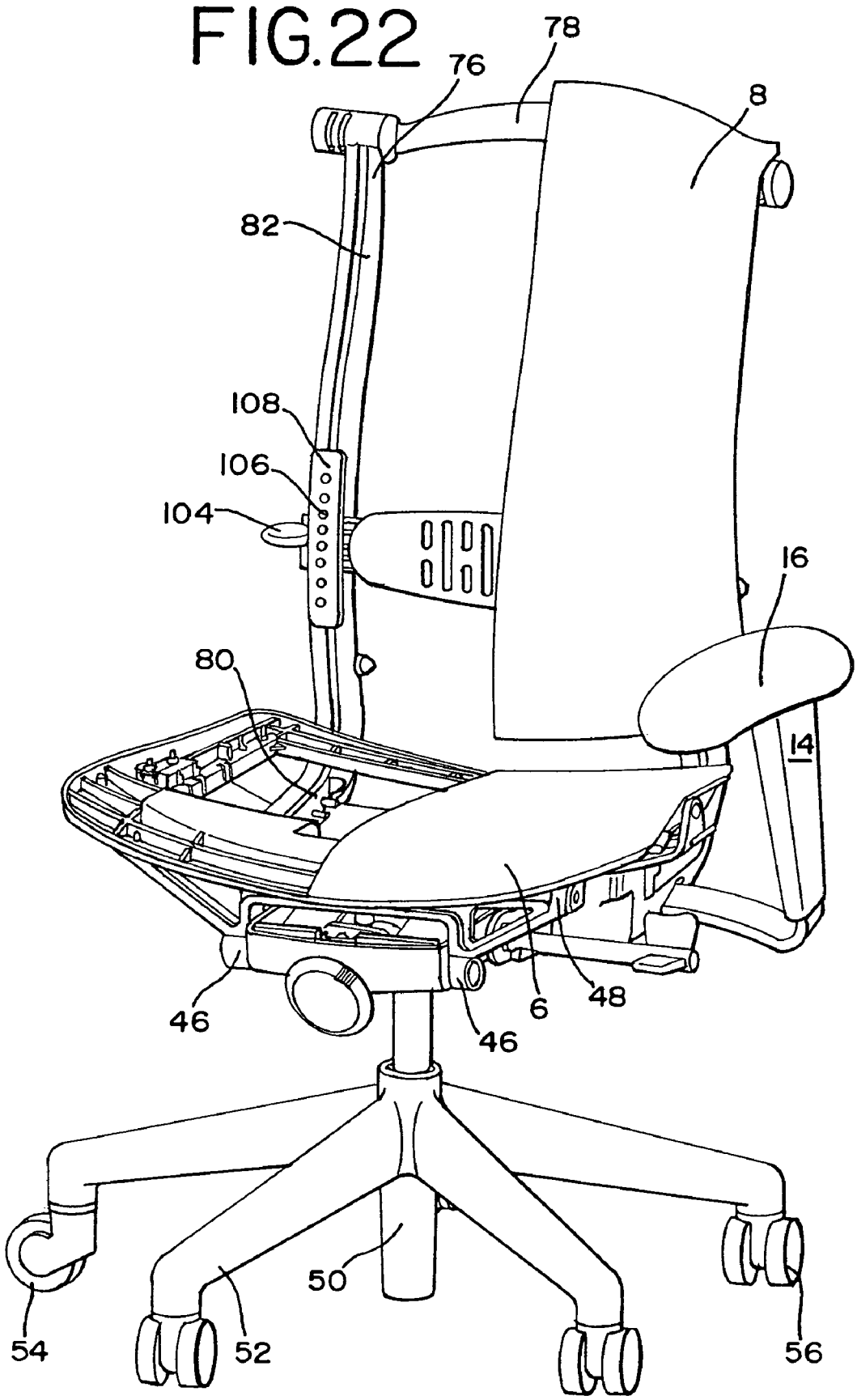
FIG. 22 is a front perspective view of one embodiment of a chair with portions of the seat and back cut away.

In either embodiment, and with reference to FIGS. 22 and 28, the uprights 76 include a first component 86, preferably made of a first material, such as a plastic, wood, fiberglass, polymer, metal, etc., including nylon and polypropylene (unfilled and glass-filled (e.g., 20%)). The first component 86 includes a groove 90, or other cavity, formed therein, preferably along a front face 92, between opposite side portions 94 of the first component defining the groove. A second component 88 is inserted in the cavity 90. Preferably, the second component 88 is made of a second material different from the first material, for example and without limitation a metal such as steel, although it should be understood that the second material can be a composite, plastic, wood, or any other material. In one embodiment, the second component 88 is configured as a metal insert, preferably formed from a sheet or plate-like member. In this way, the metal insert can be easily manufactured by stamping or cutting, yet still provide increased bending strength due to its vertical orientation. The metal insert 88 provides various engagement locations 96, 98 or surfaces for joining the back to other components. At the same time, the metal insert 88 is substantially hidden from view, such that the back frame 74 is provided with a pleasing aesthetic appearance. It should be understood that the composite frame structure, otherwise referred to as a laminated beam structure, can be incorporated into other seating structure components, including without limitation the seat and armrests.

In one embodiment, shown in FIGS. 24 and 27, the metal insert includes a flange 100 that extends upwardly and provides an engagement location 96 formed as a pivot joint for the seat defining the second pivot axis. The flange 100 can be bent as desired. In another embodiment, shown in FIG. 27, the metal insert includes a second engagement location, formed as a rack 98 formed on a front edge thereof, which is exposed to the front of the frame member. The back support or armrests can be configured with a latch device that releasably engages the rack to secure one or both of those components in a desired position, as shown for example in FIG. 2. Various back and arm configurations are disclosed in U.S. Provisional Application No. 60/381,769 filed May 20, 2002 and PCT Application PCT/US03/16034, filed May 20, 2003, the entire disclosures of which are hereby incorporated herein by reference.

Figure 23:
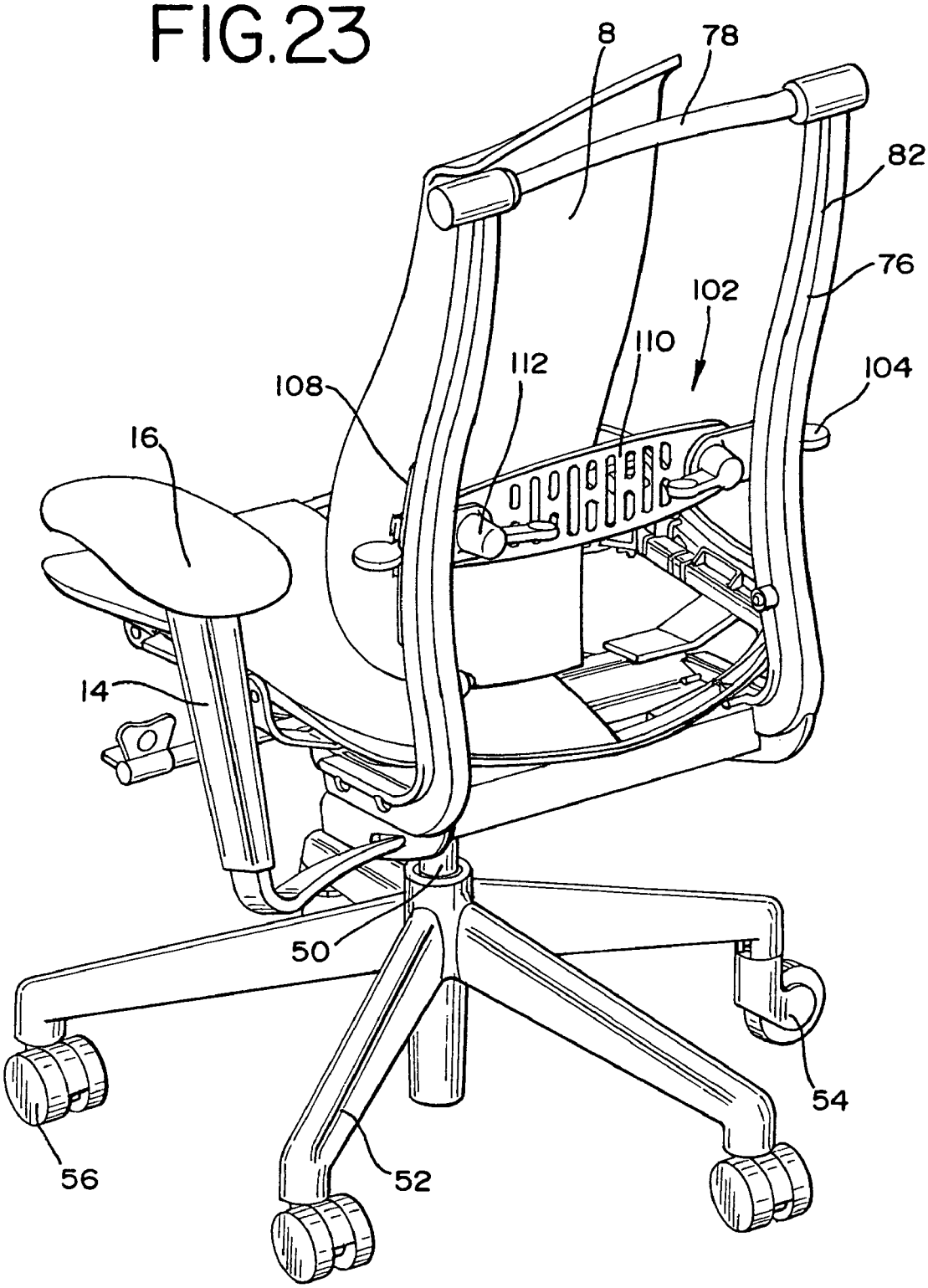
FIG. 23 is a rear perspective view of the chair shown in FIG. 22.

Referring to FIGS. 22-24, a lumbar support 102 is secured to a front of the vertical frame members. The lumbar support is vertically adjustable along the frame members. A pair of end supports 104 are trapped between the frame and a strap 108 secured to the frame. The end supports are vertically moveable between the frame and strap to a plurality of positions. The strap includes a plurality of openings 106, allowing a latch device to secure the end supports to the strap at one of the openings. The latch device can include a simple detent, or a moveable latch. The lumbar support further includes a belt 110 extending between the end supports the belt can be tightened or loosened by a pair of adjustment members 112.

Figure 39:
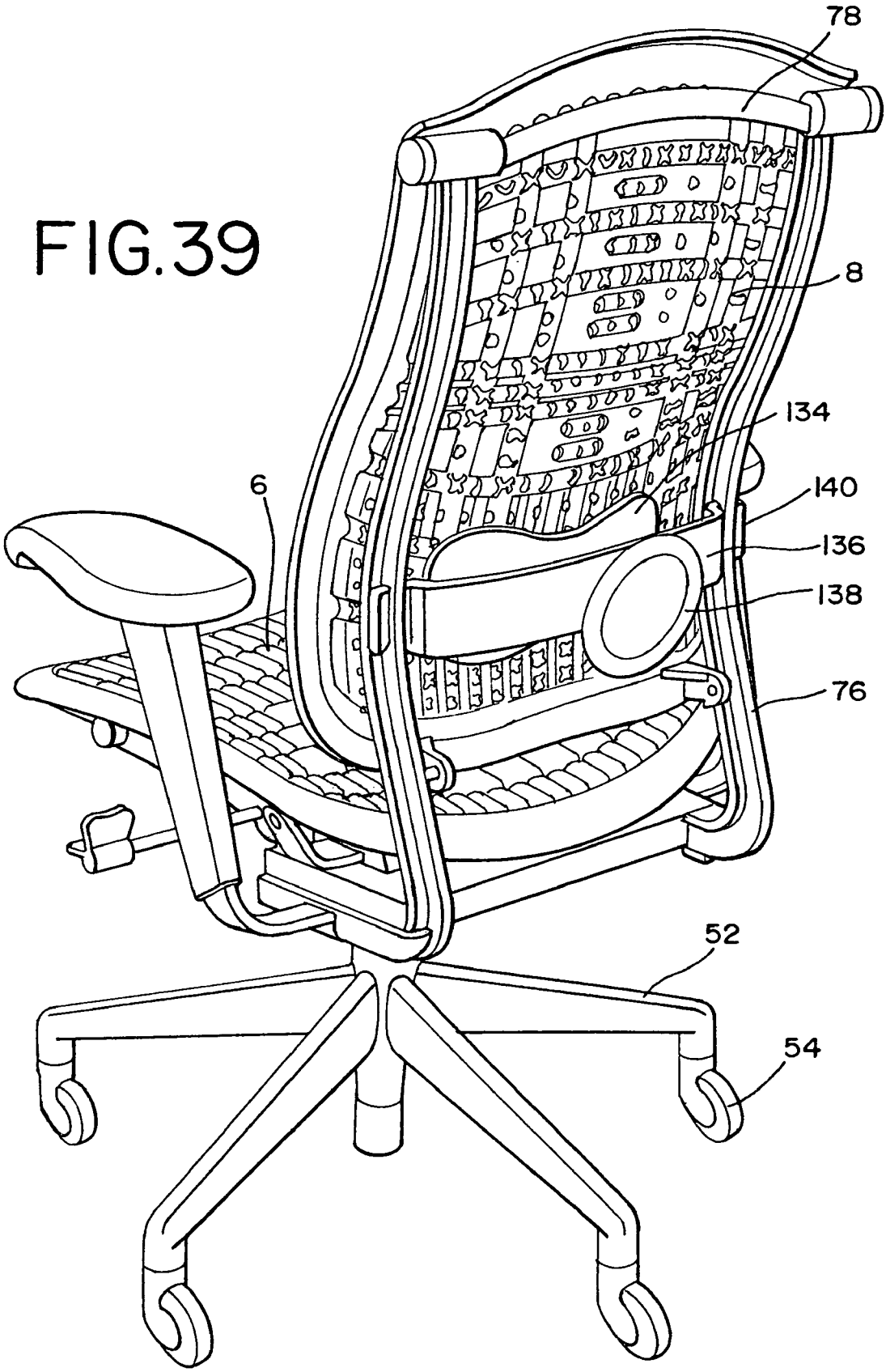
FIG. 39 is a rear perspective view of the embodiment shown in FIG. 38.

In another embodiment, shown in FIG. 39, the lumbar includes a cross member 136 secured to the uprights and a body support member 134 disposed between the cross member and the rear surface of the back seating surface 8. An adjustment member 138, including for example a knob 140 and screw, can be used to adjust the fore/aft position of the support member 134 relative to the cross member 136 and seating surface 8.

Figure 10:
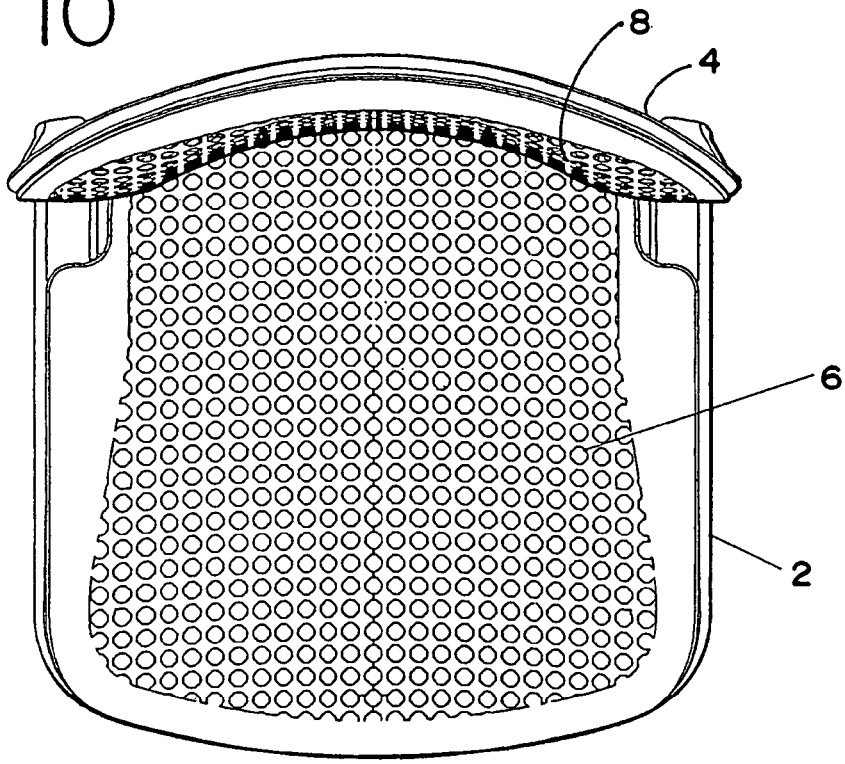
FIG. 10 is a top view of a seating structure.
Figure 11:
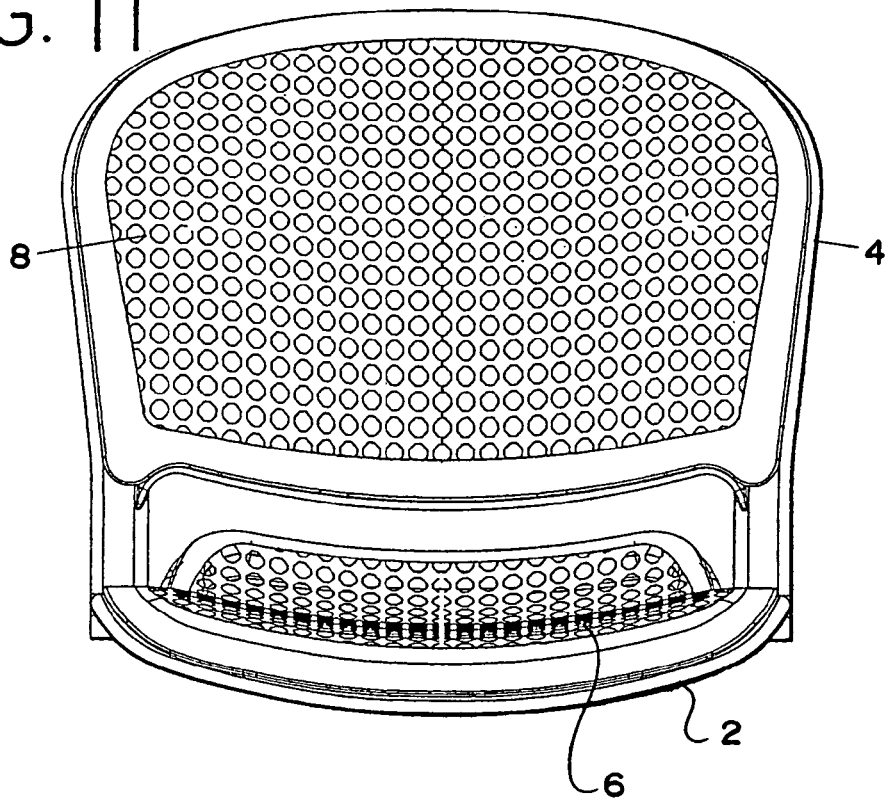
FIG. 11 is a front view of the seating structure shown in FIG. 10.
Figure 12:
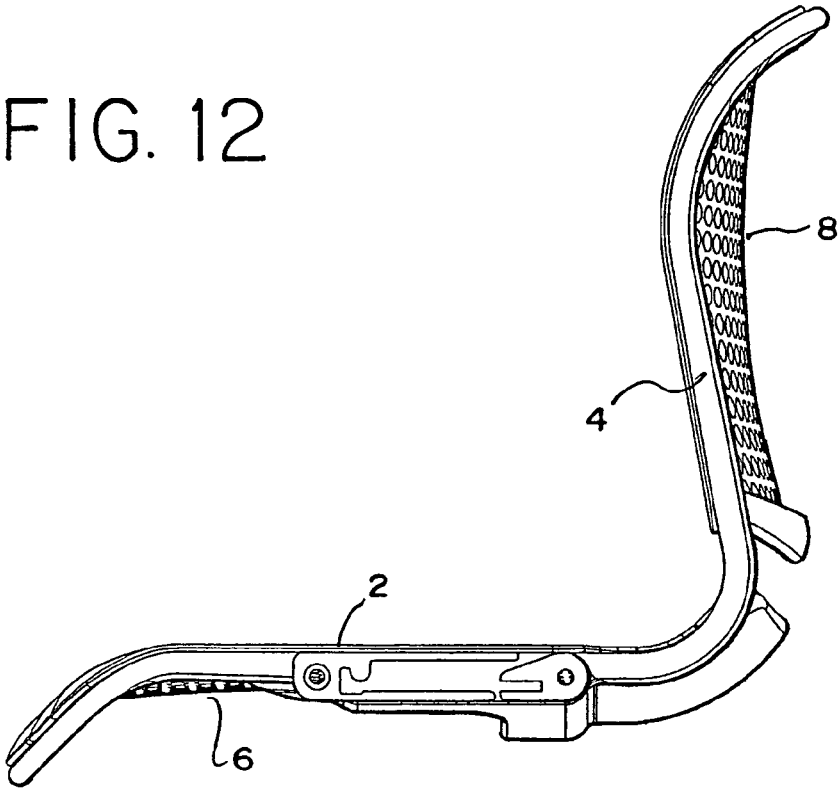
FIG. 12 is a side view of the seating structure shown in FIG. 10.

Referring to FIG. 10, a top view of one embodiment of a seating support structure shows a seat-pan seating structure 6 or surface and its support frame 2 and a back support structure 8 and its support frame 4 can be seen. Referring to FIGS. 3-6, the shells or pans 6, 8, can be seen separate from the frames 2, 4, and the frames can be seen separate from the seating surface shells or pans in FIGS. 1, 2, 7, 8, and 9. Also, it should be noted that a separate peripheral support frame is not a necessity of the invention, for the shells 6, 8 could be self-supporting with an integral structure, or surrounding, integral frame 66 as shown for example in FIGS. 30-32. Additionally for clarification, a seat-pan, or back-pan seating surface refers to a structure which may be the primary support surface, as in a plastic or wood chair, or a structure which may accept foam and upholstery and thus not be the primary support surface as can be commonly found in many articles of furniture. Of course, the seat pan or back pan seating surface can also be covered with only a thin membrane, for example and without limitation fabric, an elastomeric material, leather, rubber etc. Often these pan structures are also referred to as seating shells. All of these and any other terms used to describe a similar structure are considered to be equivalents and should be viewed as such.

Figure 3:
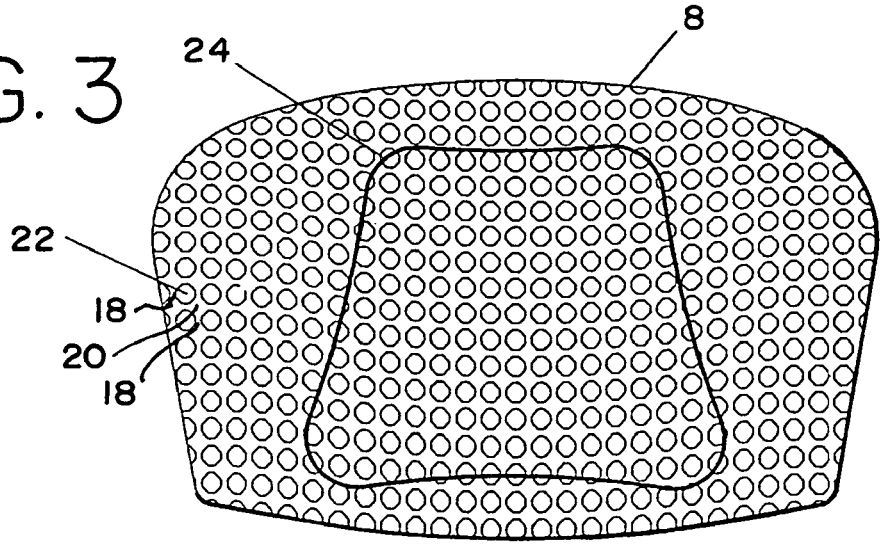
FIG. 3 is a front view of one embodiment of a back support.
Figure 4:
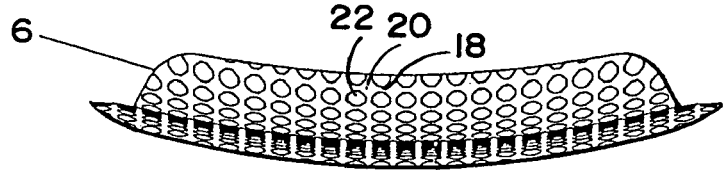
FIG. 4 is a front view of one embodiment of a seat support.
Figure 5:
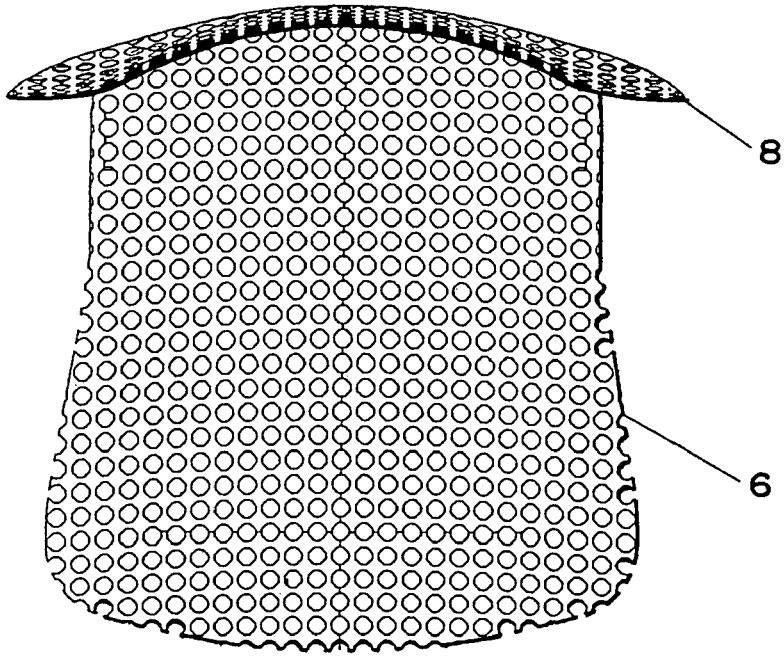
FIG. 5 is a top view of the back support and seat support shown in FIGS. 3 and 4.
Figure 6:
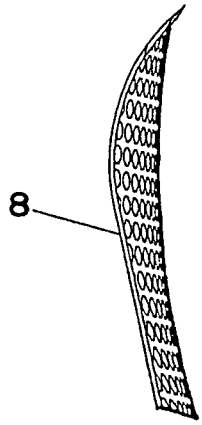
FIG. 6 is a side view of the back support shown in FIG. 3.

Now referring to FIGS. 3 and 4 it can be seen that the seating surface 6, 8 is comprised of a plurality of webs 18, thicker sections configured as bosses/platforms 20, and openings 22. It is through the various geometric combinations of these three basic elements that improved seating comfort is achieved. This configuration or matrix is referred to as being "cellular" in nature, for it is a matrix of individual, independently acting cell structures. In one embodiment, all three of these structures are formed economically from one type of material and process such as plastic and molding. Any of the common molding methods known could be used including, but not limited to, injection, blow, or roto-molding. Additionally, through the use of advanced plastic injection molding techniques known to those in the industry as "two-shot" injection molding and "co-injection" molding, these elements may be selectively made from two or more types of materials to further control the overall engineering attributes of the structure. Additionally, this structure could be realized through other manufacturing techniques such as lamination, stamping, punching etc.

Figure 16:
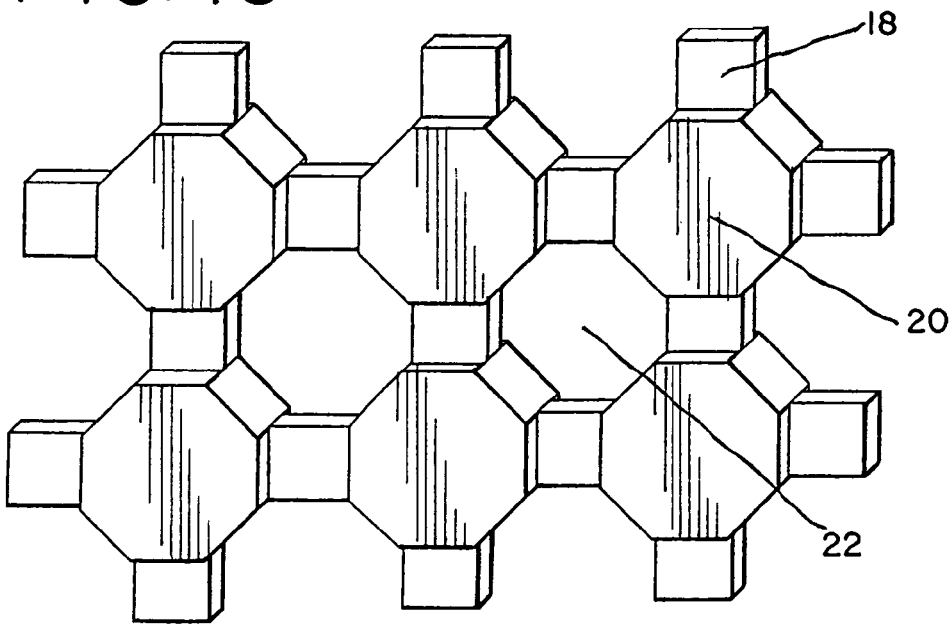
FIG. 16 is a partial perspective view of one embodiment of a support structure.

Referring to FIG. 16, an enlarged view of a portion of the matrix shows that the webs 18 function as thinner or more flexible interconnecting elements to the thicker or more rigid bosses/platform sections 20. It is through these webs that flexure occurs, allowing movement of one thicker or more rigid section relative another thicker section. Of course, it should be understood that the web structures and boss structures can have the same thickness. Depending upon the final geometry selected this movement may have several degrees of freedom.

For example, as shown in FIG. 16, the web structure 18 is predominantly flat in form. The web structure may act as a both a torsional flexure (occurring predominantly across the webs width) for the thicker or more rigid bosses/platform sections, as well as a linear flexure along its length. Additionally, depending on the characteristics of the materials used, the web may stretch or elongate in length, allowing another form of displacement.

Figure 14:
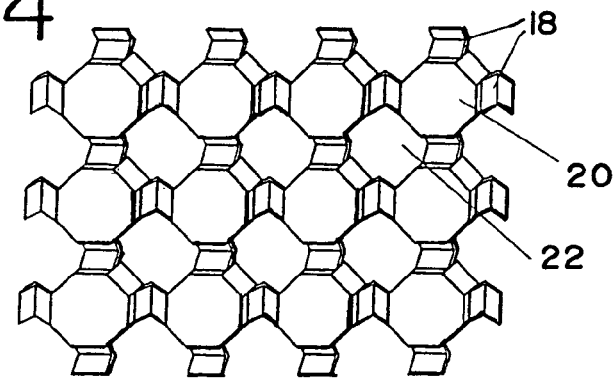
FIG. 14 partial view of a seating support structure configured with web structures having a V-shaped cross-section.
Figure 15:
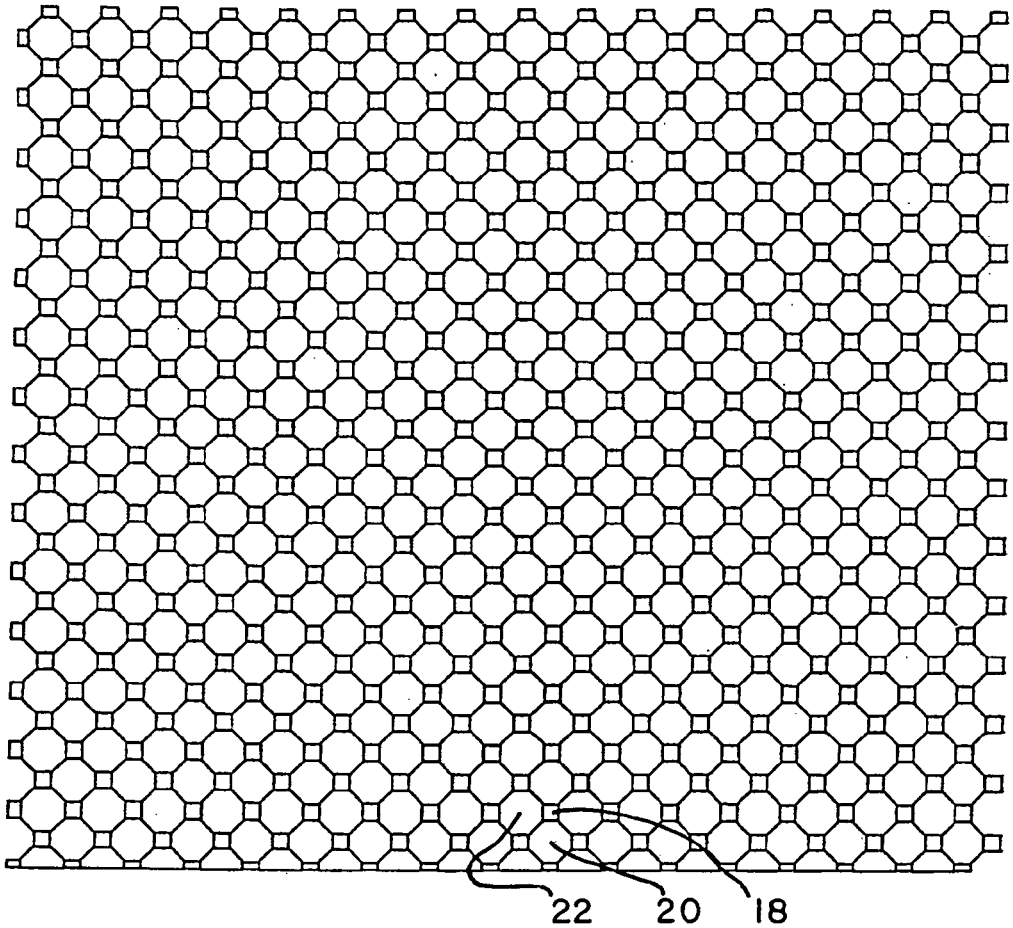
FIG. 15 is a partial plan view of a support structure.

Alternatively, the web can be formed as shown in FIG. 14. In this embodiment, the web structure 18 is formed as a V, or an inverted V. The web structure 18 may exhibit the preceding characteristics as well as act as a living hinge allowing the angle formed by the faces of the V to change. This would result in a different set of degrees of freedom of one boss/platform section relative to another.

Figure 13:
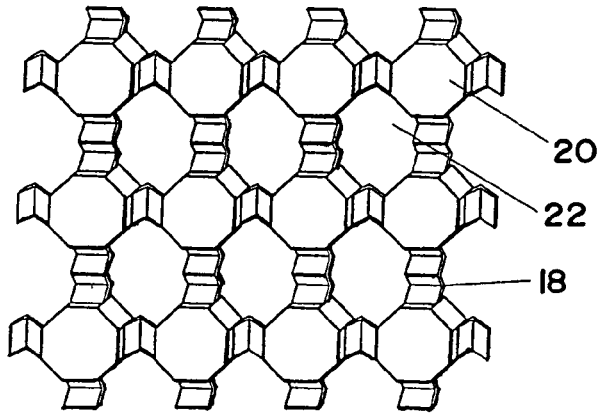
FIG. 13 is a perspective partial view of a seating structure configured with some web structures having a V-shaped cross-section and some web structures having a W-shaped cross-section.

FIG. 13 shows a configuration predominantly the same as FIG. 14. Of note is the fact that the web structures may also take the form of a W or inverted W, which could further increase flexibility. Also of note is the fact that the web structures can be varied, with V-shaped web structures used in some areas or directions and W-shaped web structures used in other areas or directions. FIG. 13 shows W-shaped web structures running vertically and V-shaped web structures running horizontally in the example section. In addition to V-shaped and W-shaped webs structures, it should be understood that other forms are also envisioned, and so a number of varied geometric possibilities exist for the web geometry as well as the bosses/platforms and holes.

All of the aforementioned forms of webs, and other contemplated designs, all may share common types of flexure of varying degrees. It should be noted that the terms "thinner" and "thicker" sections are interchangeable with the terms "sections having greater" or "sections having less" flexibility relative to each other.

Figure 20:
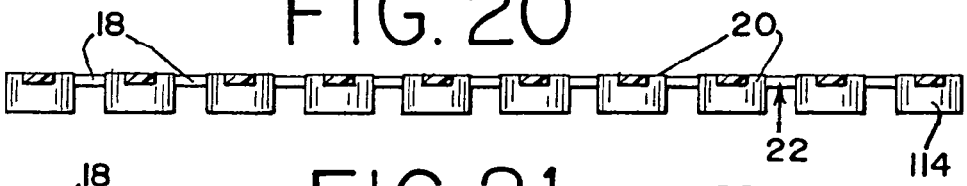
FIG. 20 is a side sectional view taken along cutting line 20-20 of FIG. 19.
Figure 21:
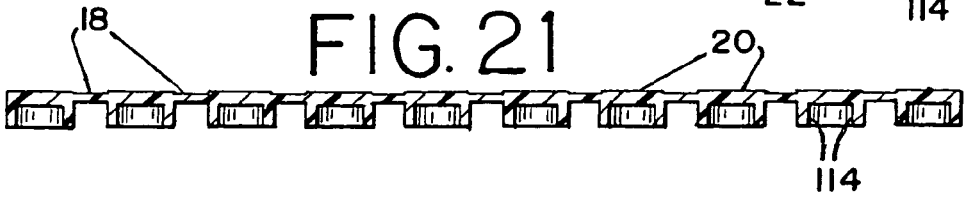
FIG. 21 is a side sectional view taken along cutting line 21-21 of FIG. 19.

Cross-sectional area or thickness is but one way of varying the relative rigidity of the webs vs. the bosses or platforms. Another way is to provide the boss structures or platforms with rigidizing returns, ribs or walls, as shown in FIGS. 20 and 21, so that structurally the bosses or platforms are stiffer than the joining webs.

Additionally, as stated earlier, the materials selected could play an important role in the performance of the geometry. For example, if the material selected is an elastomeric material, such as a urethane, the webs 18 could each stretch or elongate a small amount resulting in or allowing deflection or displacement of the thicker or more rigid bosses/platform sections 20. Another flexible material that may be suitable is Hytrel® polyester elastomer by Dupont. Other suitable materials are polypropylene (e.g., unfilled), PBT, etc. Since each area or boss structure with connecting web structures responds individually, the entire seating surface may emulate a soft cushioning effect to the occupant.

As also mentioned earlier, it is possible through advanced molding techniques or fabrication, to use more than one type of molded material in a finished product. One such technique is to mold a part in one material in one mold and then place the part into another mold that has additional cavity area, and then fill that mold with another type of material. So it may be advantageous to for example to mold all the webs and connective areas in one material in one mold, and then to transfer the part to another mold to form all the thicker or more rigid bosses/platform sections and other features in another material.

In one embodiment, openings 22 otherwise referred to as holes or areas lacking material, are formed in and/or between the web structures so as to allow airflow through the seating structure and thereby reduce the amount of heat build up on the seating surface. These holes 22, or areas with no material, further serve to allow the desired movement of the webs and the thicker sections. As shown, the holes are octagons, but any shape found suitable could be used, including circular holes and X-shaped holes and V-shaped holes (when viewing the holes or openings in a direction substantially perpendicular to the support surface of the seating structure). In one embodiment, it is desirable to maintain the smallest dimension of the hole or opening less than 8 mm, such that an 8 mm probe cannot be passed therethrough.

Figure 17:
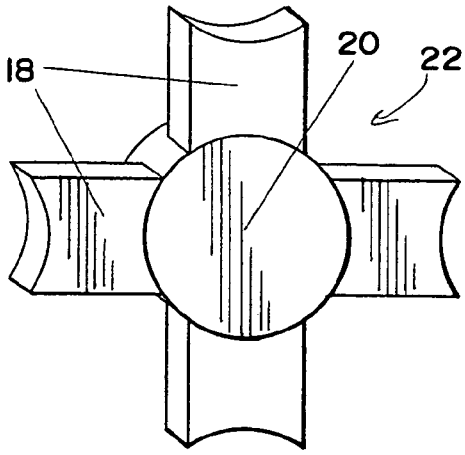
FIG. 17 is an enlarged partial perspective view of another embodiment of a support structure.
Figure 18:
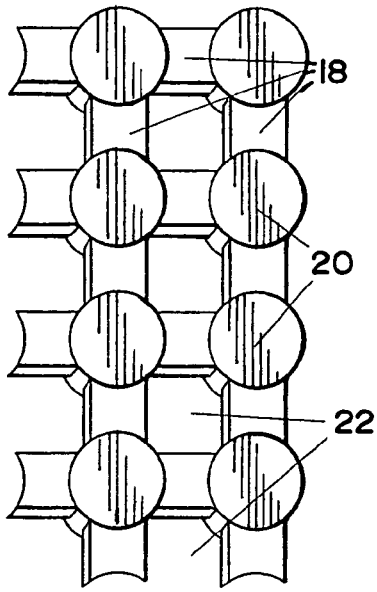
FIG. 18 is a partial perspective view of one embodiment of a support structure.
Figure 19:
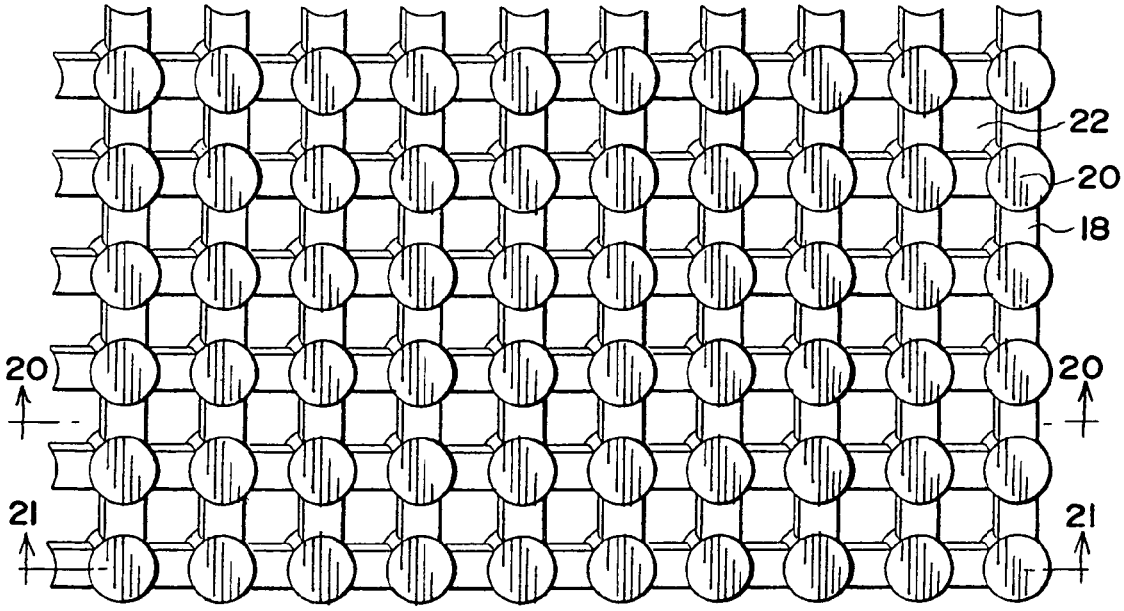
FIG. 19 is a partial perspective view of one embodiment of a support structure.

Referring to FIG. 17, a single structural relationship is depicted, showing another form the web structure may assume. The difference of this form of web structure can be appreciated by referring to FIGS. 19, 20, and 21. Rather than the bosses/platforms 20 being thicker in cross-sectional than the web connecting members 18, the bosses/platforms are provided with structural returns or reinforcing ribs 114. In this way, the bosses/platforms will have a greater structural rigidity relative to their interconnecting web members. FIG. 20 which is a sectional view taken along cutting line 20-20 of FIG. 19 and FIG. 21 which is a sectional view taken along cutting line 21-21 of FIG. 19, show that the bosses/platforms 20 have reinforcing returns 114 that make the bosses/platforms more rigid than the connecting web structure. As shown the return wall 114 on the bosses/platforms forms a ring. This is not a necessity though, the returns could be as simple as a single rib or as complex or as many returns as are needed.

One aspect of this invention is the ability of the designer/manufacturer to precisely control and alter all aspects of the deflection of the seating surface from area to area simply and controllably. In contrast, when a designer/manufacturer specifies a foam density (firmness/softness) for a cushion, the entire cushion may be compromised by that unifying density. That is not the case with this invention though.

Biomapping is datum created through the comparison of body contours of a given population, or the datum created through the comparison of contact forces exerted between a seating surface and the occupant. Although exercises in generating data have been ongoing for several years, the designer is still limited to selecting generic contours, then hoping that the foam would resolve the final fitting issues. With the present invention, however, it is possible to effectively use the data generated by biomapping to precisely control of the geometry (web-connectors, bosses/platforms, and openings) and thus the engineering properties area by area over the entire seating surface, so that each sector-area is functionally optimized.

So it should be appreciated that by varying the size and shape of the holes, the location of holes, the types of webs and their relative thickness, geometry and size, contour and relative thickness of the boss structures or their geometry, a designer can custom design each area of a seating surface to perform as desired. FIG. 3 shows how the seating surface could be divided into zones; one such zone is indicated by area 24. This could be the zone of greatest flexibility. It should also be appreciated the advantage this offers the designer when he/she is trying to economically manufacture an item from a material such as plastic, as well as the increased comfort that the user will experience.

Figure 35:
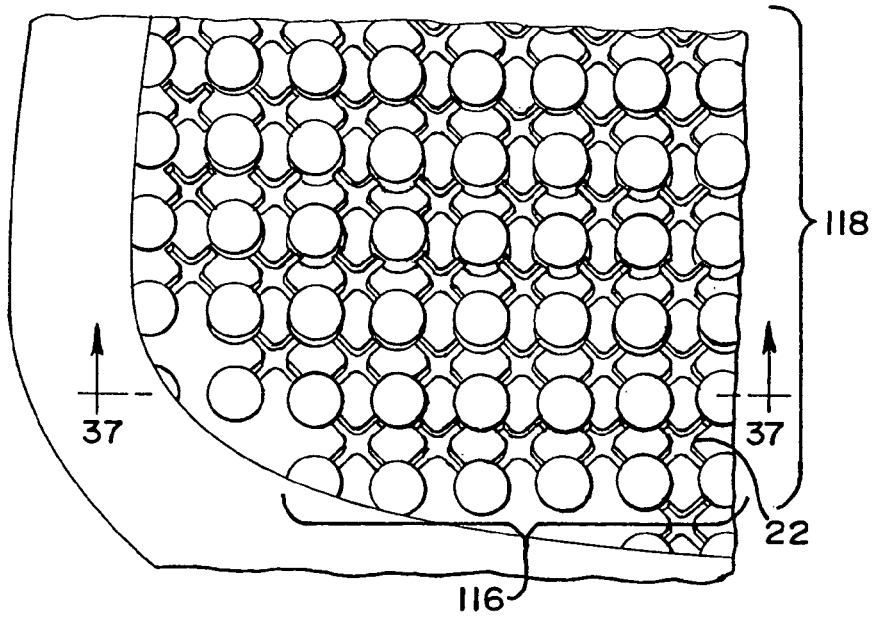
FIG. 35 is a top, perspective view of a portion of another embodiment of a support member.
Figure 36:
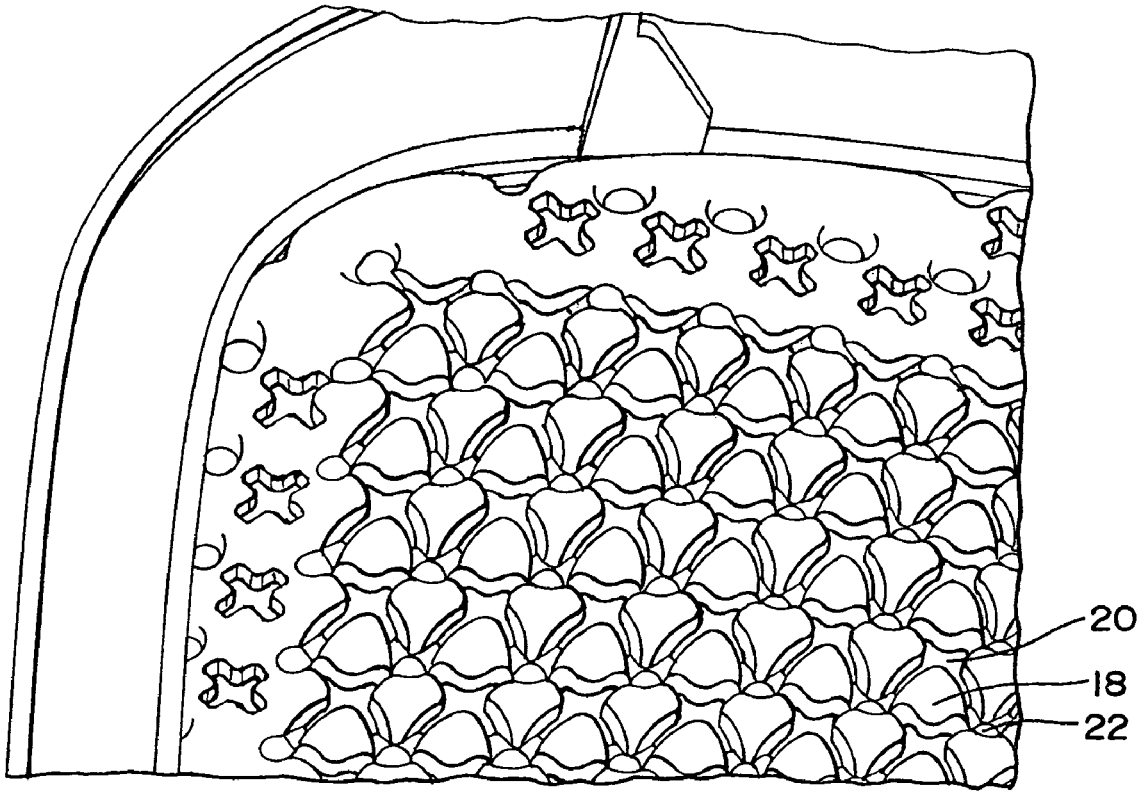
FIG. 36 is a bottom, perspective view of the support member shown in FIG. 35.
Figure 37:
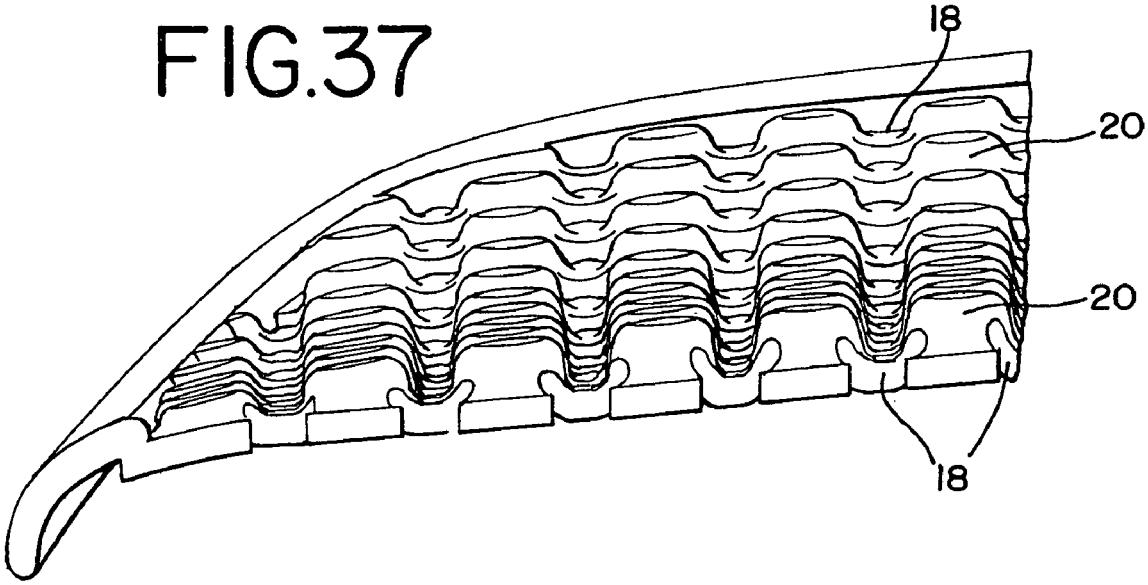
FIG. 37 is a cross-sectional view of the support member taken along line 37-37 of FIG. 35.
Figure 38:
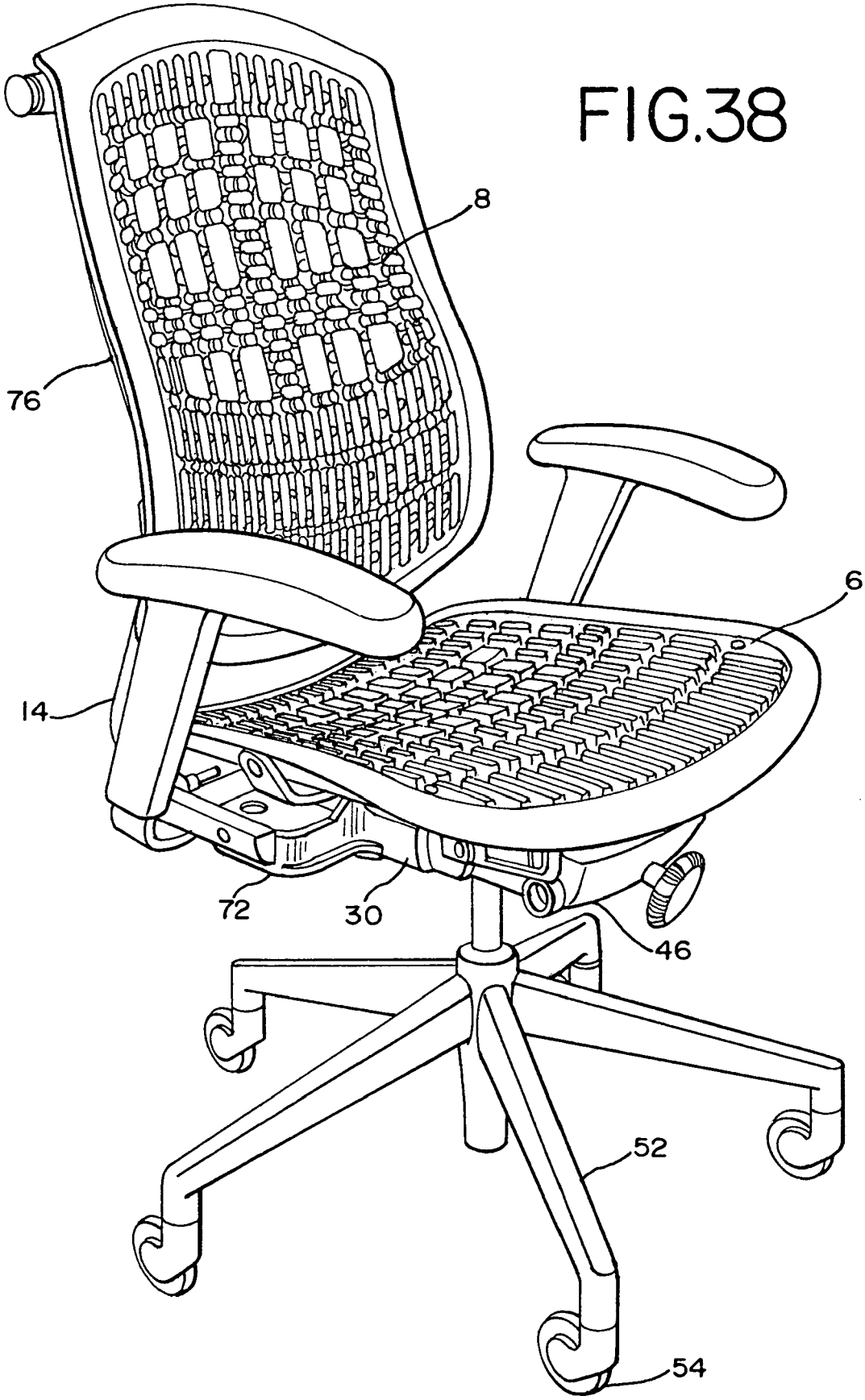
FIG. 38 is a front perspective view of one embodiment of a chair.

Referring to FIGS. 35-37, another embodiment of a support structure is shown as having a plurality of boss structures 20 arranged in a grid-like pattern of rows 116 and columns 118 of boss structures. A plurality of web structures 18 connects adjacent boss structures 20. Preferably, the boss structures have a circular cross-section when viewed from a direction substantially perpendicular to the support surface defined by the plurality of boss structures. However, the boss structures can have any desired shape. In one embodiment, the width of the web structures varies, with it being the greatest at the middle thereof, where the hinge apex is located. This structure provides an X-shaped opening 22 between adjacent web structures connected to adjacent boss structures 20.

Figure 30:
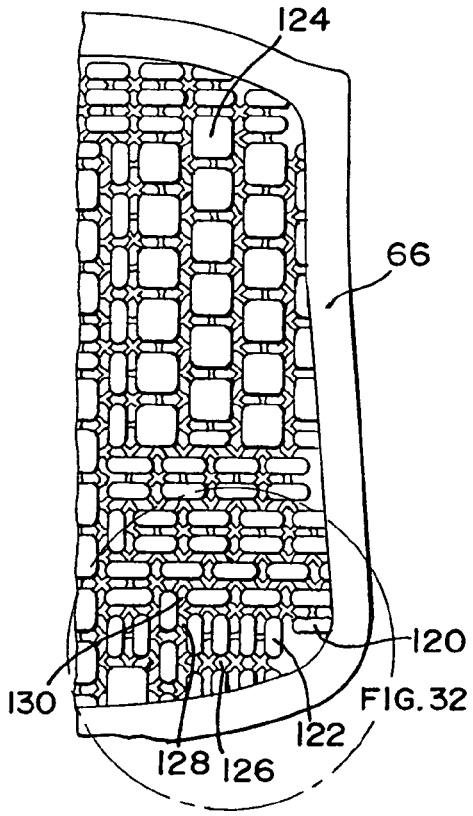
FIG. 30 is a partial front view of one embodiment of a back support member.
Figure 31:
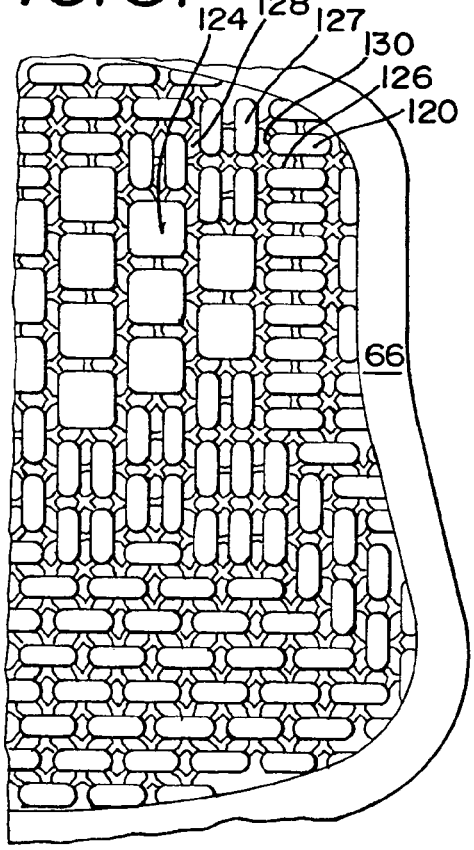
FIG. 31 is a partial top view of one embodiment of a seat support member.
Figure 32:
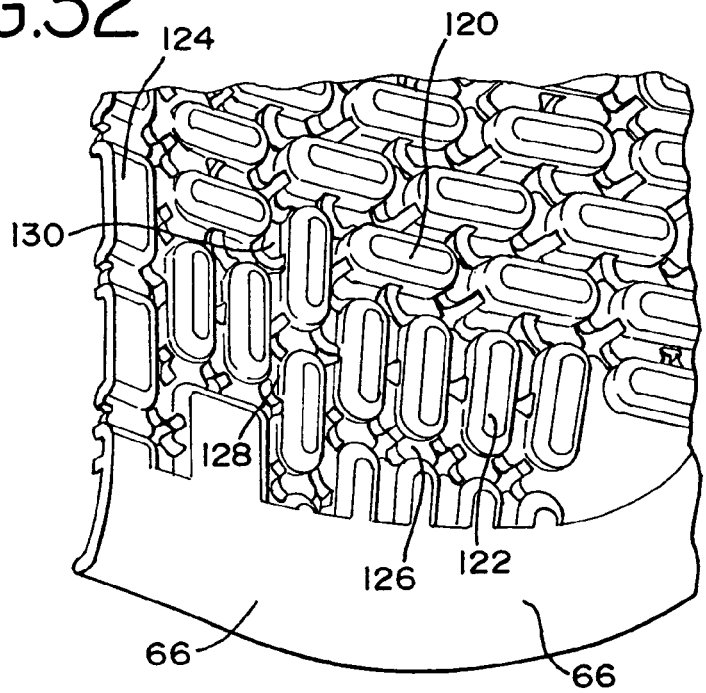
FIG. 32 is an enlarged perspective view of the back support member taken along line 32 in FIG. 30.
Figure 33:
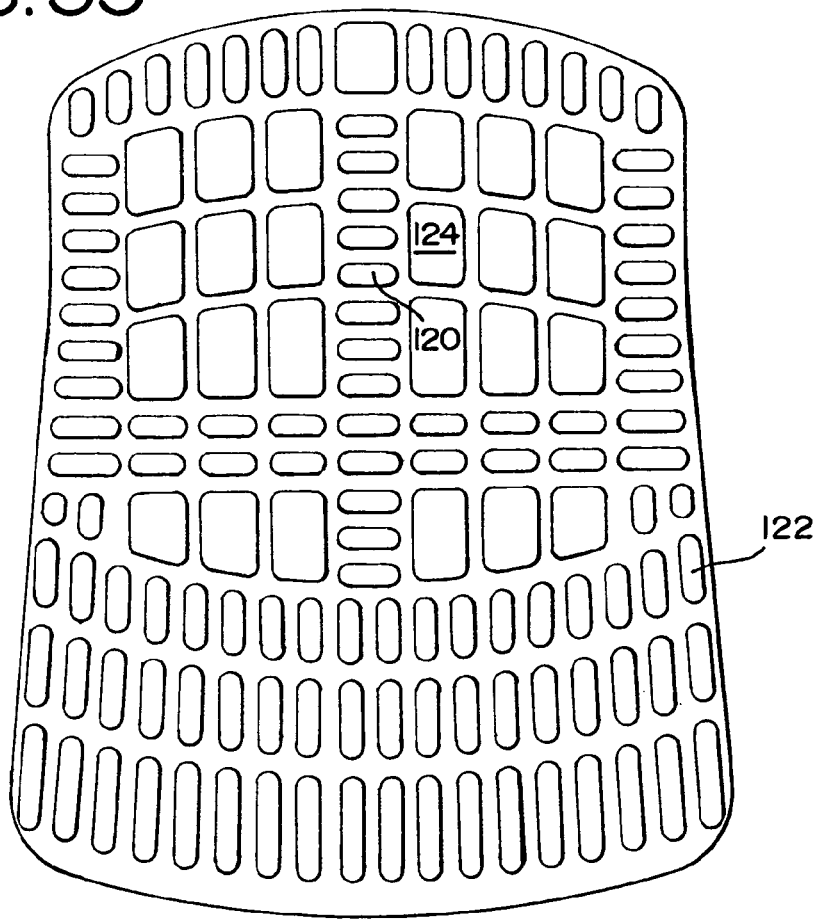
FIG. 33 is a front view of another embodiment of a back support member.

Referring to FIGS. 30-34, other embodiments of support structures are shown with the boss structures 20 and web structures 18 arranged in different patterns. In various embodiments, shown in FIGS. 30 and 33, a back support includes a plurality of laterally (horizontally) elongated boss structures 120, a plurality of longitudinally (vertically) elongated boss structures 122, and a plurality of larger rectangular (shown as substantially square) boss structures 124. In one embodiment, the larger boss structures 124 have a width and height approximately equal to the respective lengths of the horizontally and vertically oriented boss structures 120, 122. The various boss structures 120, 122, 124 can be arranged in various patterns and configurations, as shown for example in FIGS. 30 and 33. It should be understood that the term "substantially rectangular" includes four-sided shapes, even though one or more sides (ends) or corners thereof may be rounded, such that they have a generally obround shape or capsule shape. The boss structures may also be tetragonal, trapezoidal or formed as parallelograms as shown for example in FIGS. 33 and 34. As shown in FIGS. 30 and 33, larger boss structures 124 are positioned in the upper regions of the back support adjacent the shoulders of the user. The embodiment of FIG. 30 further includes larger boss structures 124 vertically positioned along the middle of the back support to support the spine of the user. The various size and orientations of the boss structures and openings provides various degrees of flex and support in desired locations. For example, the larger boss structures provide a greater surface area in contact with the user and assist in distributing the loads of the user. In addition, the orientation can indicate a direction of travel of the user relative to the seating surface, for example by providing longitudinally (or laterally) elongated boss structures on the seat.

As shown in FIGS. 30, 32 and 33, web structures 126, 128, 130 connect adjacent boss structures. When the boss structures are offset in the horizontal or vertical direction, the web structures 128, or a portion thereof (e.g. one or both sides), have a diagonal orientation. In one juncture, the web structure 130 has a linear diagonal side and a "peaked" side with two edges forming an angle or apex. Other web structures 126 are formed as described above, with a varying width, such that the openings formed between the web structures are either substantially X-shaped (small or large) or V-shaped. Preferably, the width is greater in the middle of the web structure of the hinge apex. The openings are not shown in FIG. 33, but would be formed between the respective web structures and boss structures as shown in FIG. 30 and 32.

Figure 34:
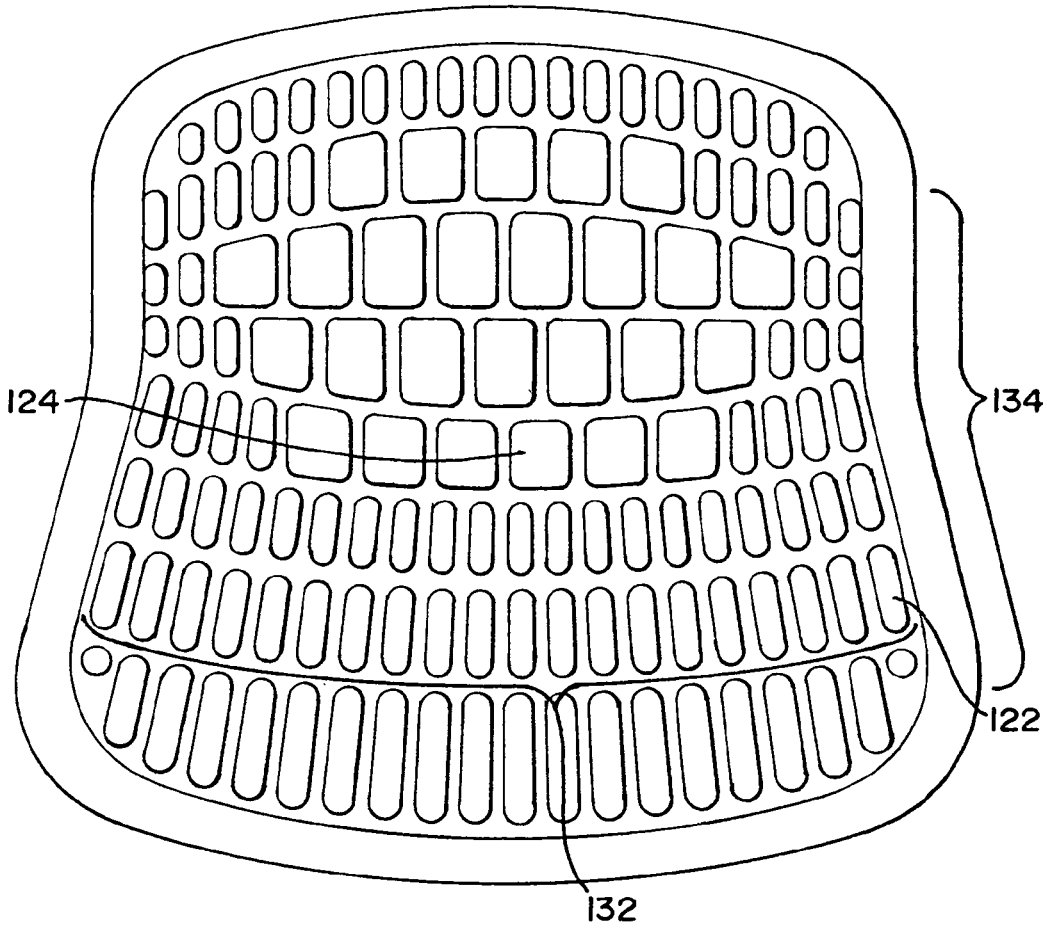
FIG. 34 is a top view of another embodiment of a seat support member.

Referring to FIGS. 31 and 34, a seat support also includes a plurality of laterally elongated boss structures 120, a plurality of longitudinally elongated boss structures 122, and a plurality of larger rectangular (shown as substantially square) boss structures 124. In one embodiment, the larger boss structures 124 have a width and height approximately equal to the respective lengths of the laterally and longitudinally oriented boss structures. The various boss structures can be arranged in various patterns and configurations, as shown for example in FIGS. 31 and 34. For example, as shown in both embodiments, larger boss structures are positioned in the rear portion of the seat adjacent the buttock of the user, while the front portion is configured with smaller longitudinally extending boss structures (FIG. 34) or smaller laterally extending boss structures (FIG. 31).

As shown in FIGS. 31 and 34, web structures 126, 128, 130 connect adjacent boss structures 120, 122, 124. When the boss structures are offset in the horizontal or vertical direction, the web structures 128, 130, or a portion thereof, again have a diagonal orientation. Other web structures are formed as described above, with a varying width, such that the openings formed between the web structures are either substantially X-shaped (small or large) or V-shaped. The openings are not shown in FIG. 34, but would be formed between the respective web structures and boss structures as shown in FIG. 31.

As shown in FIGS. 33 and 34, the boss structures 122 can be arranged in a generally curved array 132 or row in the lateral direction. For example, as shown in FIG. 34, the boss structures can be angled outwardly from the back to the front of the boss structure, and gradually straightened as one moves along the array from the outside in. In the rear portion of the seat as shown in FIG. 34, or at the top of the back as shown in FIG. 33, the length of the boss structures 122 within a particular row or array can be varied to provide the curved configuration, or the boss structures can be longitudinally offset. Of course, it should be understood that arrays 134 or columns of boss structures extending in the longitudinal direction can also be curved, as shown in FIGS. 33 and 34, to form or follow a contour, for example the contour of the outer peripheral frame. The curvature can be achieved by orientation (e.g., angling of the boss structures), by altering the relative width of the boss structures within the columns, or by adjusting the lateral offset of the boss structures relative to each other.

Referring to FIGS. 7-9, one embodiment of a seat frame 2 and back frame 4 are shown. The frames 2, 4 are preferably, substantially more rigid than the seat and back seating surfaces or structure formed by the web and boss structures. The frames provide a support structure for the seating surface, and as a means to connect the seating surface to the rest of the chair. In one contemplated embodiment the seating surface is carried within the seating frame by way of mounting grooves 10 and 12.

It should be appreciated that the seating surface and the frame could be formed or manufactured as a single unit, as shown in FIGS. 30-31. However, some advantages may be realized if they are separate. For example, the frame and seating surface can be made of different materials. In this way, each of the materials selected for their respective part may be optimized functionally. Another advantage is that the way in which the two members, the seating surface and its frame, are attached may be varied. Techniques of manufacture and assembly could be used which would allow movement relative to one another. This would give yet more degrees of movement and cushioning to the occupant.

An example of an attachment means is a rubber mount that may take the form of a series of intermediate mounting pads, which occur between the seating surface and its frame. Similarly, the rubber or resilient material could take the form of a gasket occurring between the seat surface and frame. Another way that such movement could be achieved is to produce a groove integral to the seating surface that would follow the same path as the mounting groove. Such a groove could be pleated like the web found in FIG. 14, and thus would allow a degree of lateral movement.

Another method would be to have the seating surface snap into place using tabs and slots that had enough free-play relative to each other to yield desirable results. Either the seating surface or the frame could have the slots and the other the tab members.

Yet another method would be to configure the two elements so that one or the other had standing legs formed predominantly perpendicular to the other element. In this way, when the two are assembled, and allowed to shift relative to each other, the legs flex. This, like the rubber or resilient mounts would allow biased relative movement, which would not feel loose. These tabs or the functionality of them could be combined with the snap tabs, as a matter of fact; any of the methods could be successfully combined.

Additionally, any of these attachment techniques could occur using mounting grooves such as 10 and 12, or could surface mount directly on the surface of the seat/back frames. It is also contemplated that the entire assembly (frames, resilient seating surface inserts, and flex gasketing material) could be manufactured using the advanced multi-material molding techniques (two-shot, co-injection) previously mentioned. This would have the potentially obvious advantages of increased economy, and ease of manufacture, and increased structural integrity.

Another consideration when configuring the way in which the seating surfaces interact with the seating frame is sizing. As previously mentioned, it can be difficult for a designer to design a chair, or other seating structure, with the proper contours appropriate for the full range of the population. The resulting designs and contours are necessarily compromises, and thus are not optimal for any given individual. As also previously mentioned, in an effort to overcome these limitations, manufacturers have produced "sized" (i.e. small, medium and large) chairs that effectively narrow the amount of contouring-compromise that the designer must normally exercise.

One of skill in the art should understand that there are several aspects to sizing. The first consideration is the overall sizing of the surfaces as far as width, height etc. As far as comfort is concerned, this is the least important aspect of seating surface design. Appropriately sized seating surfaces can be formulated that satisfy the extremes. Of more importance is the contouring that occurs within whatever sized seating surface is chosen. Often, the contouring varies greatly from a small individual, to a large one. Additionally, some individuals who seemingly share the same body types prefer differing contours, for example stronger/weaker lumbar contours. Although the present invention addresses this need for variable contouring through its innovative flexure structure, further advantages in comfort can be realized if the initial contours of the seating structure are in the proper range for the occupant.

Through the unique method of construction disclosed herein, these goals are all achievable. As previously outlined, the seating surfaces can be attached to the seating frame by a variety of methods. Therefore, the manufacturer can produce one basic chair frame(s) and insert many different contoured seating surfaces. Obviously, this has the advantage of eliminating the need of the manufacturer having to tool three independent products instead of one. In addition, because the seating surfaces are so easily attached and detached from their frames, it is conducive to a field-customization. In this way, wholesalers, and retailers could stock frames, and then have a variety of seating surfaces in various contours and colors.

This would allow the retailer to customize the product on the spot for the customer. Additionally, the end user is not stuck with a chair that at some point in the future may be the wrong size. The size/color scheme can be updated at any point of the products life by simply obtaining a fresh set of seating surfaces.

Thus, a new and improved method of chair seat and back pan construction, which provides greater comfort through superior surface adjustment for a variety of users, has been provided. Also provided is a new and improved method of chair seat back pan construction that provides greater airflow to contact areas of the occupant's body. Also provided is a new and improved method of chair seat back pan construction that is more efficient and economical to produce.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A seating structure comprising:

a plurality of boss structures arranged in a pattern, wherein each of said boss structures has a body-facing surface, wherein said body-facing surface of at least one of said plurality of boss structures is a different size and shape than said body-facing surface of at least another of said plurality of boss structures;

a plurality of web structures joining adjacent boss structures within said pattern, wherein at least some of said web structures are non-planar, said non-planar web structures extending away from said body-facing surface of said adjacent boss structures and forming a hinge structure between adjacent boss structures, with said body-facing surface being more proximal to an occupant than said web structures when the occupant is supported by the seat structure; and wherein at least some adjacent web structures defining said plurality of web structures are spaced apart such that said spaced apart adjacent web structures define openings therebetween.

2. The seating structure of claim 1 wherein said plurality of boss structures and said plurality of web structures define at least in part a seat having a front portion adapted to support the thighs of a user and a rear portion adapted to support the buttock of the user, wherein at least some of said plurality of boss structures defining said rear portion have a greater surface area than at least some of said plurality of said boss structures defining said front portion.

3. The seating structure of claim 1 wherein said plurality of boss structures and said plurality of web structures define at least in part one of a seat and back.

4. The seating structure of claim 1 wherein said web structures are thinner in section than said boss structures.

5. The seating structure of claim 1 wherein said boss structures comprise a first portion defining a body-facing support surface and at least one rib extending from said first portion in a direction away from support surface.

6. The seating structure of claim 1 wherein at least some of said boss structures are connected to a frame.

7. The seating structure of claim 1 wherein at least some of said web structures are connected to a frame.

8. The seating structure of claim 1 wherein at least some of said web structures are V-shaped.

9. The seating structure of claim 1 wherein said web structures are spaced apart from said body-facing surface, with said body-facing surface being more proximal to an occupant than said web structures when the occupant is supported by the seating structure.

10. The seating structure of claim 1 further comprising a covering disposed over at least some of said plurality of boss structures and said plurality of web structures.

11. A seating structure comprising:

a plurality of boss structures arranged in a pattern, wherein each of said boss structures has a body-facing surface, wherein at least some of said boss structures are elongated and have a longitudinal extent and a lateral extent, wherein said longitudinal extent of at least some of said boss structures is greater than said lateral extent of said at least some of said boss structures;

a plurality of web structures joining adjacent boss structures within said pattern, wherein at least some of said web structures are non-planar, said non-planar web structures extending away from said body-facing surface of said adjacent boss structures and forming a hinge structure between adjacent boss structures, with said body-facing surface being more proximal to an occupant than said web structures when the occupant is supported by the seat structure; and wherein at least some adjacent web structures defining said plurality of web structures are spaced apart such that said spaced apart adjacent web structures define openings therebetween.

12. The seating structure of claim 11 wherein said body-facing surfaces of at least some of said plurality of boss structures are substantially obround.

13. The seating structure of claim 11 wherein said body-facing surfaces of at least some of said plurality of boss structures are substantially rectangular.

14. The seating structure of claim 13 wherein at least some of said substantially rectangular boss structures are substantially square.

15. A seating structure comprising:

a plurality of boss structures arranged in a pattern, wherein each of said boss structures has a body-facing surface;

a plurality of web structures joining adjacent boss structures within said pattern, wherein at least some of said web structures are non-planar, said non-planar web structures extending away from said body-facing surface of said adjacent boss structures and forming a hinge structure between adjacent boss structures, with said body-facing surface being more proximal to an occupant than said web structures when the occupant is supported by the seat structure, and wherein each of said plurality of web structures have a width, wherein said width of at least some of said web structures varies along a length of said web structure; and wherein at least some adjacent web structures defining said plurality of web structures are spaced apart such that said spaced apart adjacent web structures define openings therebetween.

16. The seating structure of claim 15 wherein said width of said at least some of said web structures is greatest in a middle portion of said length of said web structure.

17. A seating structure comprising:

a plurality of boss structures arranged in a pattern;

a plurality of web structures joining adjacent boss structures within said pattern, wherein at least some of said web structures are non-planar and wherein each of said plurality of web structures have a width, wherein said width of at least some of said web structures varies along a length of said web structure; and wherein at least some adjacent web structures defining said plurality of web structures are spaced apart such that said spaced apart adjacent web structures define openings therebetween, and wherein said at least some of said web structures each have a hinge apex, wherein said width of said web structure is greatest at said hinge apex.

18. A seating structure comprising:

a plurality of boss structures arranged in a pattern and defining a support surface;

a plurality of web structures joining adjacent boss structures within said pattern; and wherein at least some adjacent web structures defining said plurality of web structures are spaced apart and shaped such that said spaced apart adjacent web structures define substantially X-shaped openings therebetween when viewed in a direction substantially perpendicular to said support surface, and wherein said plurality of boss structure comprises at least a first boss structure have a first lateral length and a first longitudinal length, wherein at least a second boss structure has a second lateral length and a second longitudinal length, wherein said first and second lateral lengths are different and said first and second longitudinal lengths are different.

19. The seating structure of claim 18 wherein said first lateral length and said second longitudinal length are substantially the same and wherein said second laterally length and said first longitudinal length are substantially the same.

20. The seating structure of claim 19 wherein said plurality of boss structures comprises at least one third boss structure having a third longitudinal length substantially equal to said first lateral length and said second longitudinal length, and a third lateral length substantially equal to said second lateral length and said first longitudinal length.

* * * * *

UNITED STATES PATENT AND TRADEMARK OFFICE

CERTIFICATE OF CORRECTION

PATENT NO. : 7,455,365 B2
APPLICATION NO. : 10/809279
DATED : November 25, 2008
INVENTOR(S) : Jerome C. Caruso et al.

It is certified that error appears in the above-identified patent and that said Letters Patent is hereby corrected as shown below:

On the Title Page, Item (56)

In column 2, line 1, under "OTHER PUBLICATIONS", delete "Y psilon" and substitute --Ypsilon-- in its place.

Page 2, column 1, line 3, after "2/1954" delete "Goessele et al." and substitute --Peterson et al.-- in its place.

Page 2, column 2, line 1, under "OTHER PUBLICATIONS", delete "Y psilon" and substitute --Ypsilon-- in its place.

Page 2, column 2, line 5, under "OTHER PUBLICATIONS", after "*Intes*" delete "*ISA*" and substitute --*USA*-- in its place.

Signed and Sealed this

Twenty-eighth Day of July, 2009

JOHN DOLL
*Acting Director of the United States Patent and Trademark Office*